US009863109B2

(12) United States Patent
DeCew et al.

(10) Patent No.: US 9,863,109 B2
(45) Date of Patent: Jan. 9, 2018

(54) CABLE MANAGEMENT FOR MARINE BARRIERS AND GATE SYSTEMS

(71) Applicant: HALO Maritime Defense Systems, Inc., Newton, NH (US)

(72) Inventors: Judson DeCew, Rochester, NH (US); Eric H. Rines, Manchester, NH (US); Michael Osienski, Londonderry, NH (US); Justin Bishop, West Caldwell, NJ (US); Eric G. Johnson, Danvers, MA (US)

(73) Assignee: HALO MARITIME DEFENSE SYSTEMS, INC., Newton, NH (US)

( * ) Notice: Subject to any disclaimer, the term of this patent is extended or adjusted under 35 U.S.C. 154(b) by 0 days.

(21) Appl. No.: 15/085,698

(22) Filed: Mar. 30, 2016

(65) Prior Publication Data

US 2016/0289907 A1 Oct. 6, 2016

Related U.S. Application Data

(60) Provisional application No. 62/140,265, filed on Mar. 30, 2015.

(51) Int. Cl.

| | |
|---|---|
| ***E02B 3/06*** | (2006.01) |
| ***B66D 1/60*** | (2006.01) |
| ***E02B 7/38*** | (2006.01) |
| ***E02B 7/50*** | (2006.01) |
| ***F41H 11/05*** | (2006.01) |

(52) U.S. Cl.

CPC ..... *E02B 3/062* (2013.01); *B66D 1/60* (2013.01); *E02B 7/38* (2013.01); *E02B 7/50* (2013.01); *F41H 11/05* (2013.01)

(58) Field of Classification Search

USPC ..... 405/30

See application file for complete search history.

(56) References Cited

U.S. PATENT DOCUMENTS 2,716,959 A 9/1955 Betts, Jr.
5,245,942 A * 9/1993 Constantinis ..... B63C 9/22 114/366
6,960,047 B2 11/2005 Knezek (Continued)

OTHER PUBLICATIONS

International Search Report and Written Opinion of the International Searching Authority dated Aug. 25, 2016 in PCT/US2016/025013.

*Primary Examiner* — Kyle Armstrong

(74) *Attorney, Agent, or Firm* — Miles & Stockbridge P.C.

(57) ABSTRACT

A marine gate has a buoyant variable length barrier and a cable management system employing two cables or lines. An opening line extends through the barrier to move the barrier from an expanded position (gate is closed) to a retracted position (gate is open) via a winch. A closing line moves the barrier from the retracted position to the expanded position using a winch. A weight is attached to the closing line for moving a submerged portion of the line to the seafloor when the barrier gate is retracted and the closing line is payed out by operation of its winch. The weighted line allows a portion or the entire cable system to be under tension at all times. The resulting cable geometry allows vessel operators confidence in knowing the cable location in the water depths at the gate, whether the gate is fully or partially opened.

7 Claims, 26 Drawing Sheets

(56) References Cited

U.S. PATENT DOCUMENTS

| | | | | |
|---|---|---|---|---|
| 7,140,599 | B1 | 11/2006 | Spink | |
| 8,739,725 | B2 * | 6/2014 | Bishop | B63G 9/04<br>114/240 B |
| 8,801,327 | B2 | 8/2014 | Johnson | |
| 2004/0018060 | A1 * | 1/2004 | Knezek | B63B 5/24<br>405/215 |
| 2006/0216116 | A1 | 9/2006 | Baker | |
| 2011/0227016 | A1 | 9/2011 | Iffergan | |
| 2014/0231734 | A1 | 8/2014 | Bishop | |

* cited by examiner

CABLE MANAGEMENT FOR MARINE BARRIERS AND GATE SYSTEMS

RELATED APPLICATIONS

The present application claims priority of U.S. Provisional Patent Application No. 62/140,265 entitled "Cable Management For Marine Barriers and Gate Systems," filed Mar. 30, 2015, which is incorporated herein by reference in its entirety.

TECHNICAL FIELD

The present subject matter relates to marine barriers and movable gates. The present disclosure has particular applicability to methods and devices for opening and closing gates, and for understanding the position of cables in the water column.

BACKGROUND

Structures for use on both land and/or water as security barrier systems have been previously developed. Such structures generally intend to stop intruding objects, and range from thick, solid walls blocking the object's progress to secured areas for disabling the propelling mechanism of the object. These structures commonly exhibit noticeable shortcomings. First, these structures are often cumbersome and time-consuming to install and erect where desired. Second, to be used as a gate, they require a small tugboat or larger vessel to push and maneuver the gate into a closed position. Third, the physical connections are heavy and must be manually operated resulting in frequent injury and man overboard situations.

One solution providing an improved marine barrier is shown in FIGS. 1*a-d* and disclosed in U.S. Pat. No. 8,379,725, which is incorporated herein by reference in its entirety. Referring to FIGS. 1*a-b*, the marine barrier 400 includes two continuous pleated rows 401, 402 of first and second respective pluralities of buoyant panels 110, to form a diamond-shaped barrier. A plurality of outboard hinges 120 and a plurality of inboard hinges 420 elastically connect opposing sides of adjacent panels 110 to form two continuous pleated rows 401, 402, such that the hinges 120, 420 are arranged in first, second, and third substantially parallel rows.

A first plurality of impact cables 430 are attached to opposing ends of the first pleated row of panels 401 and pass through each of the hinges 120 in the first row of hinges 410*a*. A second plurality of impact cables 430 are attached to opposing ends of the second pleated row of panels 402 and pass through each of the hinges 120 in the third row of hinges 410*c*. In this particular version of the barrier, there are five impact cables 430 associated with each of the pleated rows 401, 402, and they are substantially parallel to each other. Impact cables 430 comprise, for example, steel wire rope.

Referring now to FIGS. 1*c-d*, when the barrier 400 is floating in a body of water 440 and a moving vessel (represented by arrow 450) impacts one or more of the first plurality of impact cables 430 attached to the first pleated row 401 of panels 110, the impact cables 430 deflect to transfer a force of the impact to one or more of the first plurality of panels 110 of the first pleated row 401, which in turn engage the water 440, and to one or more of the second plurality of panels of the second pleated row 402, which in turn engage the water 440, to transfer the force of the impact to the water 440 and arrest the motion of the vessel. The load path of the impact force of the moving vessel is shown by lines L, M, and N, representing the impact force as it moves from the impact cables 130 (lines L) to the panels 110 (lines M) and the hinges 120 and 420 (lines L and N).

Likewise, if a vessel impacts one or more of the second plurality of impact cables 430 attached to the second pleated row 402, the load path of the impact force will be similar, but in an opposite direction to lines L, M, N. Thus, during an impact the panels 110 are drawn in around the point of impact and engage the water to dissipate the impact force.

The marine barrier of FIGS. 1*a-d* is a vast improvement over previous barriers, as it has the unique ability to collapse into a retracted position along its length. In FIGS. 2*a-d*, the diagrammatic representation of how the marine barrier of FIG. 1 operates is shown. In the marine barrier gate 800, the first tow cable and the catenary cable are respectively permanently attached to the barrier 400*c* and the second buoy 640, and are long enough to be submersible. When the gate 800 is open these cables sit on the sea floor, and when the gate is to be closed the cables rise and come under tension (by operation of their respective winches) to expand and close the gate. To open the gate, the barrier 400*c* is pulled along the catenary cable, and when the gate is fully retracted, the cable tension is released by the winches and the two cables drop to the seafloor under their own weight.

As shown in FIG. 2*a*, a submersible tow cable 810 is fixedly attached to the second end hinge 421*b* of the second row of hinges 410*b* of barrier 400*c*, and is extendible by the first tow winch 640*a* to a position below a surface 820*a* of body of water 820 when the panels 110 of barrier 400*c* are in the retracted position; i.e., when the gate 800 is open. A submersible catenary cable 830 is fixedly attached to the second buoy 640 at attachment point 640*d*, and is extendible by the catenary winch 620*a* to a position below the surface 820*a* of the body of water 820 when the panels 110 of barrier 400*c* are in the retracted position.

As shown in FIGS. 2*b-c*, when the gate 800 is to be closed the submersible catenary cable 830 is reeled in by catenary winch 620*a* to a desired tension or length, so it will absorb catenary loads on the barrier 400*c* when the panels 110 are moved from the retracted position to the expanded position. The submersible tow cable 810 is then reeled in by first tow winch 640*a* to pull the barrier 400*c* across the gate span in the direction of arrow P (see FIG. 2C). The latch 640*c* of the second buoy 640 engages the second end hinge 421*b* to retain the barrier 400*c* in the expanded position. FIG. 2*d* shows the barrier 400*c* fully expanded, and the marine barrier gate 800 thereby closed.

When the barrier 400*c* is in the expanded position of FIG. 2*d* and it is desired to move it to the retracted position, the latch 640*c* of the second buoy 640 is disengaged from the second end hinge 421*b* of barrier 400*c*. The second tow cable 740 is then reeled onto the second tow winch 620*b* (see FIG. 2*c*), while the first tow winch 640*a* extends the submersible tow cable 810 to allow the second tow cable 740 to move the panels 110 from the expanded position to the retracted position in the direction of arrow Q. Meanwhile, the catenary winch 620*a* maintains a length or tension of the submersible catenary cable 830 such that the submersible catenary cable 830 absorbs catenary loads on the barrier 400*c* when the panels 110 are moved from the expanded position to the retracted position by operation of the second tow winch 620*b*.

After the barrier 400*c* is retracted by operation of the second tow winch 620*b*, the first tow winch 640*a* further reels out submersible tow cable 810, which sinks under the surface 820*a* of the water 820; for example, to the sea floor.

Likewise, the catenary winch 620*a* reels out submersible catenary cable 830, which sinks under the surface 820*a* under its own weight. The gate 800 is now open, as shown in FIG. 2*a*, and vessels can pass between the buoys 620, 640. Further, the gate 800 is reset and ready to be closed again when necessary.

Although barrier 800 has many advantages, the management of the cables and understanding of the position of the cables in the water column is not optimized for maximum effectiveness. In addition, the cable management system in these figures uses three cables and three winches which, disadvantageously, has high maintenance requirements.

There exists a need for a marine barrier with improved cable management for opening and closing the gate in a variety of environmental conditions and deployment sites and for helping ensure the cable/line is under tension.

Systems and technologies exist for transferring or moving a floating structure, such as a ferry or barge, across bodies of water. These systems typically employ a single line that spans the channel, with the structure connected to the line at some point in between. The structure is then moved by a combination of two winches, one that pays out the line, and a second opposing winch simultaneously pulling the structure and taking line in off the first winch.

The cable operation methods and technologies described in this document are inherently different than such systems for the following reasons, and are described in more detail in the following sections. In this application, two lines are employed of similar or different material, subjected to different tensions; the line is then brought down to the seafloor allowing clear passage of the channel using a variety of methods described herein, with the position of both cables known at all times and used to identify when the channel is clear for passage.

SUMMARY

The present disclosure provides a marine security barrier system that addresses the aforementioned needs.

Embodiments include a marine barrier that can be fully or partially opened and closed using two lines or cables having distributed or lumped weight characteristics, such that the position of the cable in the water column is defined by the line characteristics. The distributed weights can be the weight of the cable itself, or separated attached weights. The weighted line allows a portion or the entire cable system to be under tension at all times. The resulting cable geometry allows vessel operators confidence in knowing the cable location in the water depths at the gate, whether the gate is fully or partially opened.

Embodiments also include the use of two different cable/line combinations, such as stainless steel cable and polymer line, to obtain a specific system response of the marine gate and position of the cable in the water column. The positions of the cable can be above or below the water surface, yet result in similar gate dynamics and system operation.

Embodiments also include a line with integrated radio frequency identification (RFID) sensors distributed throughout, and antenna/RFID readers located in the water column or seafloor to measure and detect the position of the cable. This cable may have integrated strength members to withstand high tensions or impulse loads.

Embodiments further comprise a system that pulls or drives a line to a pre-determined depth. This includes the use of pulley/fairlead type systems and winches to pull the surface line to the seafloor, and/or the use of a mechanical fixture to force the line below the water surface.

In one embodiment, a marine gate comprises a buoyant, variable length barrier gate, wherein when the barrier gate is floating in a body of water, the barrier gate is movable from a fully expanded position where the barrier gate extends from a substantially stationary first attachment point to a substantially stationary second attachment point remote from the first attachment point, to a retracted position where the barrier gate extends from the first attachment point to a location between the first and second attachment points. The first attachment point is attached to a first end of the barrier gate. The marine gate further comprises an opening winch disposed at the first attachment point and having an opening line attached proximal to a free end of the barrier gate opposite the first end of the barrier gate, for moving the barrier gate from the fully expanded position to the retracted position by operation of the opening winch; a closing winch disposed at the second attachment point and having a closing line attached proximal to the free end of the barrier gate, for moving the barrier gate from the retracted position to the fully expanded position by operation of the closing winch. A weight is attached to the closing line for moving a submerged portion of the closing line to the bottom of the body of water when the barrier gate is in the retracted position and the closing line is payed out by operation of the closing winch.

In another embodiment, instead of the weight the marine gate has a first down winch having a first pull-down line in engagement with the closing line proximal the free end of the barrier gate; and a second down winch having a second pull-down line in engagement with the closing line proximal the second attachment point. The first and second down winches are disposed for respectively paying in the first and second pull-down lines to move a submerged portion of the closing line to be proximal to the bottom of the body of water when the barrier gate is in the retracted position and the closing line is payed out by operation of the closing winch.

In yet another embodiment, instead of a weight or a pair of pull-down lines/winches, the marine gate has first and second push-down mechanisms, spaced apart from each other and disposed between the second attachment point and the free end of the barrier gate when the barrier gate is in the retracted position. The push-down mechanisms engage the closing line to move a submerged portion of the closing line to be proximal to the bottom of the body of water when the barrier gate is in the retracted position and the closing line is payed out by operation of the closing winch.

Objects and advantages of embodiments of the disclosed subject matter will become apparent from the following description when considered in conjunction with the accompanying drawings. Additionally the different configurations discussed in the sections below may be performed in a different order or simultaneously with each other.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Disclosed herein are marine barrier and gate systems incorporating advanced cable management techniques that simplify and improve existing gate operations, improve reliability, and allow the operators to better understand the location and tension of the cables/line at or below the water surface.

Weighted Cable Operation

Figure 6A:
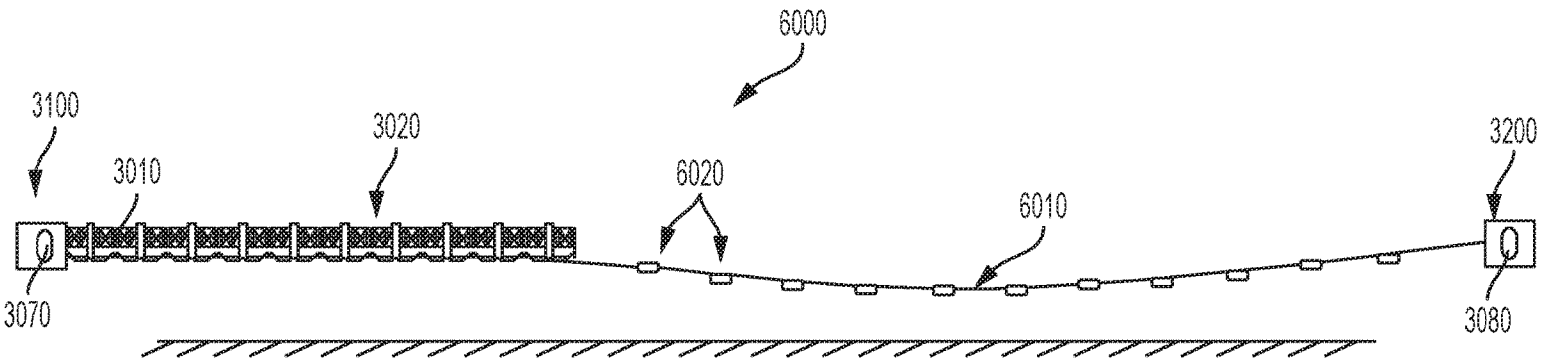
FIGS. 6*a-c* illustrate a marine gate according to another embodiment of the present disclosure, and its operation.
Figure 6B:
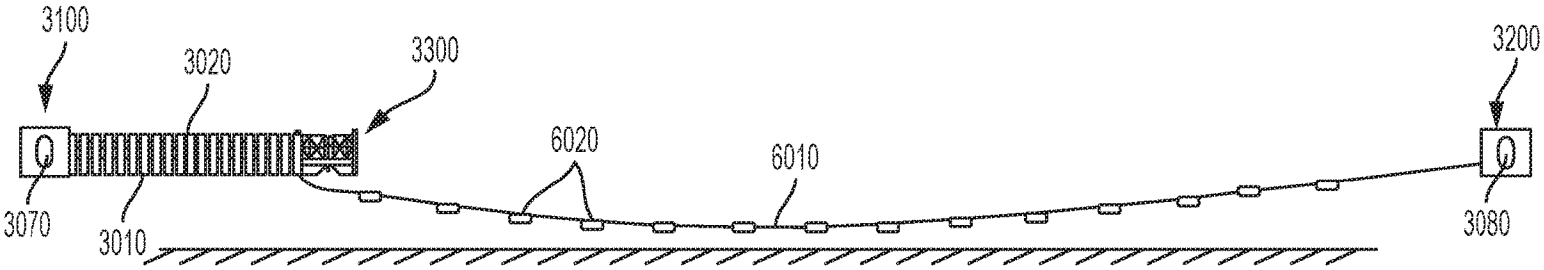
Figure 6C:
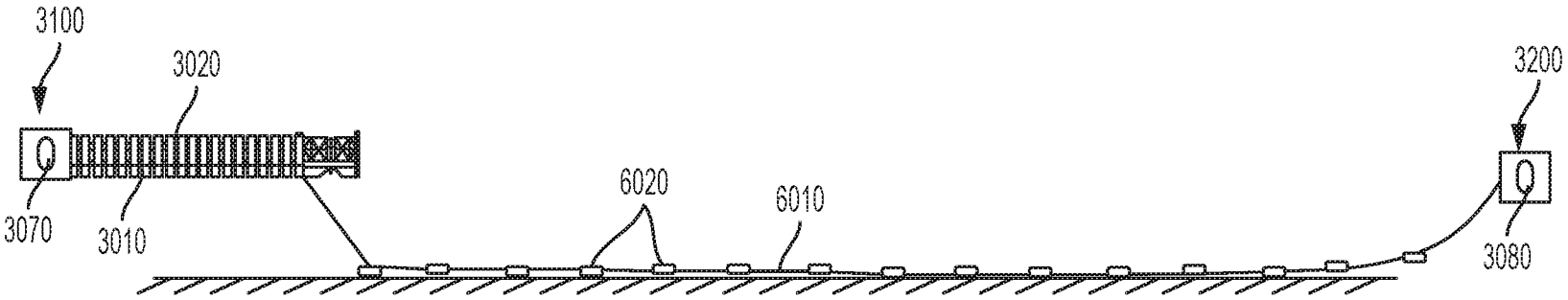

A marine gate according to an embodiment of the disclosure will now be described. Referring to FIGS. 3*a-f*, a marine barrier gate 3000 is opened and closed using two lines 3010, 3030, such as conventional cables comprising rope, polymer, or wire. Opening line or cable 3010, used to open (collapse) the gate 3000, runs through a barrier 3020. Closing line or cable 3030, used to close (expand) the gate, can have a lumped weight 3040 or a plurality of distributed weights 6020, as shown in FIGS. 6*a-c*.

Figure 5:
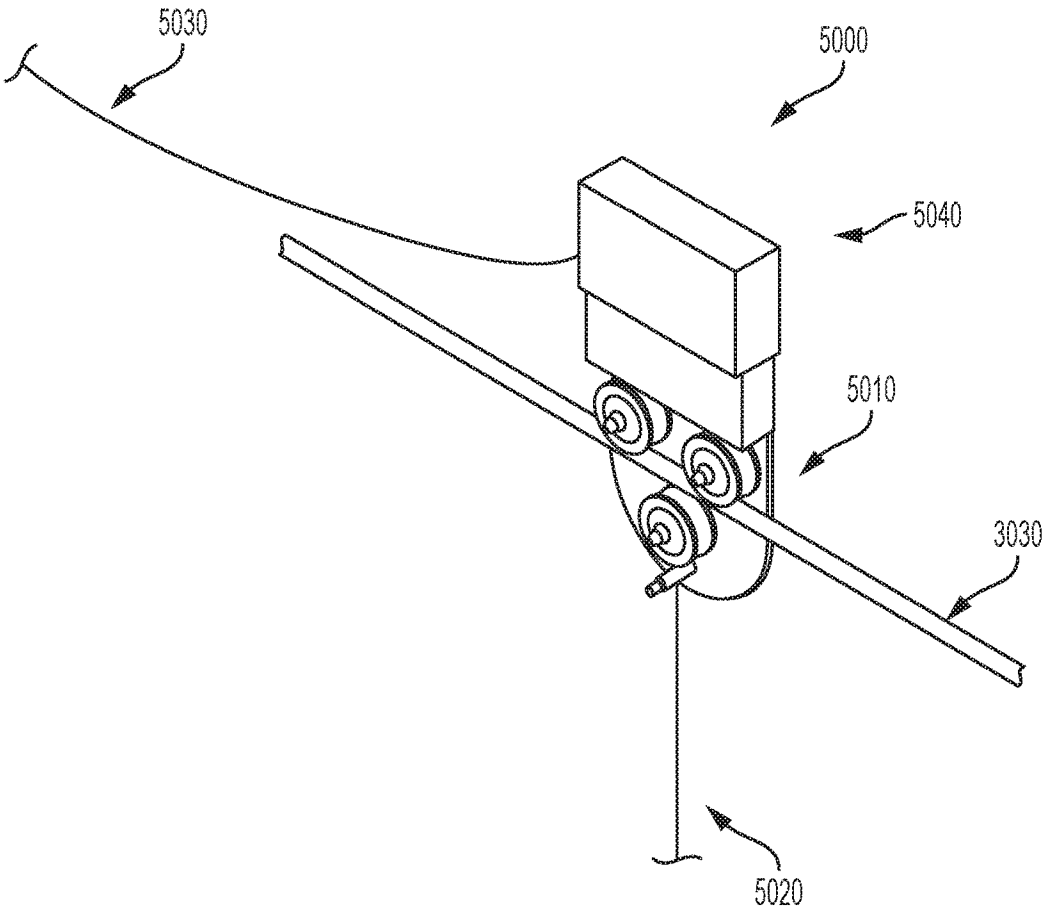
FIG. 5 illustrates a rolling sheave for securing a weight to a closing line according to the present disclosure.

The weight 3040 is shown to be connected rigidly (i.e., in-line of the closing cable 3030), however the weight 3040 could also be suspended on the closing line 3030 using a rolling sheave assembly 5000 as shown in FIG. 5, and tethered to the end of the barrier 3020. The position of the weight 3040 is adjusted to allow it to rest on the seafloor 3050 in a variety of environmental conditions and water depths specific to the deployment site. The weight 3040 is typically heavier than the length of the closing cable 3030 by a minimum of two times the total weight of the closing cable 3030 that spans the channel (i.e., the body of water in which the gate is deployed). The weight 3030 or weights 6020 can be flexible such as in a chain, or rigid as in beams or bars.

The positions of the weights are used in conjunction with the amount of cable in the channel to insure system tension and/or depth of the closing cable in the water column.

In certain embodiments, both opening and closing cables 3010, 3030 are attached to the barrier 3020 at one location 3060 near the nose of the barrier 3020. The use of the weighted closing cable 3030 and characteristics of the gate 3000 subject each line 3010, 3030 to different forces. The opening line 3010 is supported within the barrier 3020 along its full length (see, FIGS. 1*a-d*) and must overcome the retracting resistance of the barrier itself. The gate closing cable 3030, with its distributed or clumped weight(s) and amount of cable in the water, must draw the barrier 3020 fully closed, overcoming environmental and operational loads.

In a three-cable design as shown in FIGS. 2*a-d*, the catenary cable is not fixed or "attached" to the barrier, so the entire barrier length can slide back and forth on the catenary cable, enabling the catenary cable to be pulled taught first, then moving the barrier open or closed on it. However, in the present two-cable design, there will always be one section of barrier that is fixed to the cables, or the barrier sections behind the "fixed" location can slide on the part of the opening cable that is inside the barrier.

In operation, an opening winch (on a floating or rigidly mounted structure) collapses the gate using the opening line/cable, which runs through the barrier. The closing cable, wound on the closing winch located on a floating or fixed structure, then pays out (i.e., line is pulled off the drum of the closing winch). Once the gate is open (collapsed), the closing winch pays out the cable a pre-determined distance. The lumped or distributed weight attached to the cable sinks and defines a system catenary and tension, allowing users to know the location of the cable at all times. The steps to close (expand) the gate are the reverse.

In one embodiment shown in FIGS. 3*a-g*, a marine gate 3000 according to the present disclosure comprises a buoyant variable length barrier gate 3020, such as shown in FIGS. 1*a-d* and described above and in U.S. Pat. No. 8,739,825. When the barrier gate 3020 is floating in a body of water, the barrier gate 3020 is movable from a fully expanded position shown in FIG. 3*a*, where the barrier gate 3020 extends from a substantially stationary first attachment point 3100 to a substantially stationary second attachment point 3200 remote from the first attachment point 3100, to a retracted position shown in FIG. 3*d*, where the barrier gate 3020 extends from the first attachment point 3100 to a location 3300 between the first and second attachment points 3100, 3200.

The first attachment point 3100 is attached to a first end 3020*a* of the barrier gate 3020. An opening winch 3070 is disposed at the first attachment point 3100, and has an opening line 3010 which is attached proximal to a second end 3020*b* of the barrier gate 3020 opposite the first end of the barrier gate 3020. This attachment point is shown as reference numeral 3060 in FIG. 3*b*. The opening line 3010 is movably supported by the barrier gate 3020 between the first attachment point 3100 and the second end 3020*b* of the barrier gate 3020. Opening line 3010 is for moving the barrier gate 3020 from the fully expanded position shown in FIG. 3*a* to the retracted position 3300 by operation of the opening winch 3070.

The winches described herein are readily-available conventional winches known to those of skill in the art and are operated in a well-known manner.

A closing winch 3080 is disposed at the second attachment point 3200, the closing winch 3080 having a closing line 3030 attached proximal to the second end 3020*b* of the barrier gate 3020; e.g., at attachment point 3060. The closing line 3030 is for moving the barrier gate 3020 from the retracted position 3300 to the fully expanded position by operation of the closing winch 3080.

A weight 3040 is attached to the closing line 3030 for moving a submerged portion of the closing line 3030 to the bottom of the body of water when the barrier gate 3020 is in the retracted position 3300 and the closing line 3030 is payed out by operation of the closing winch 3080. As explained herein below with reference to FIGS. 6*a-c*, in certain embodiments weight 3040 comprises a plurality of weights distributed along the closing line 3030.

Figure 1A:
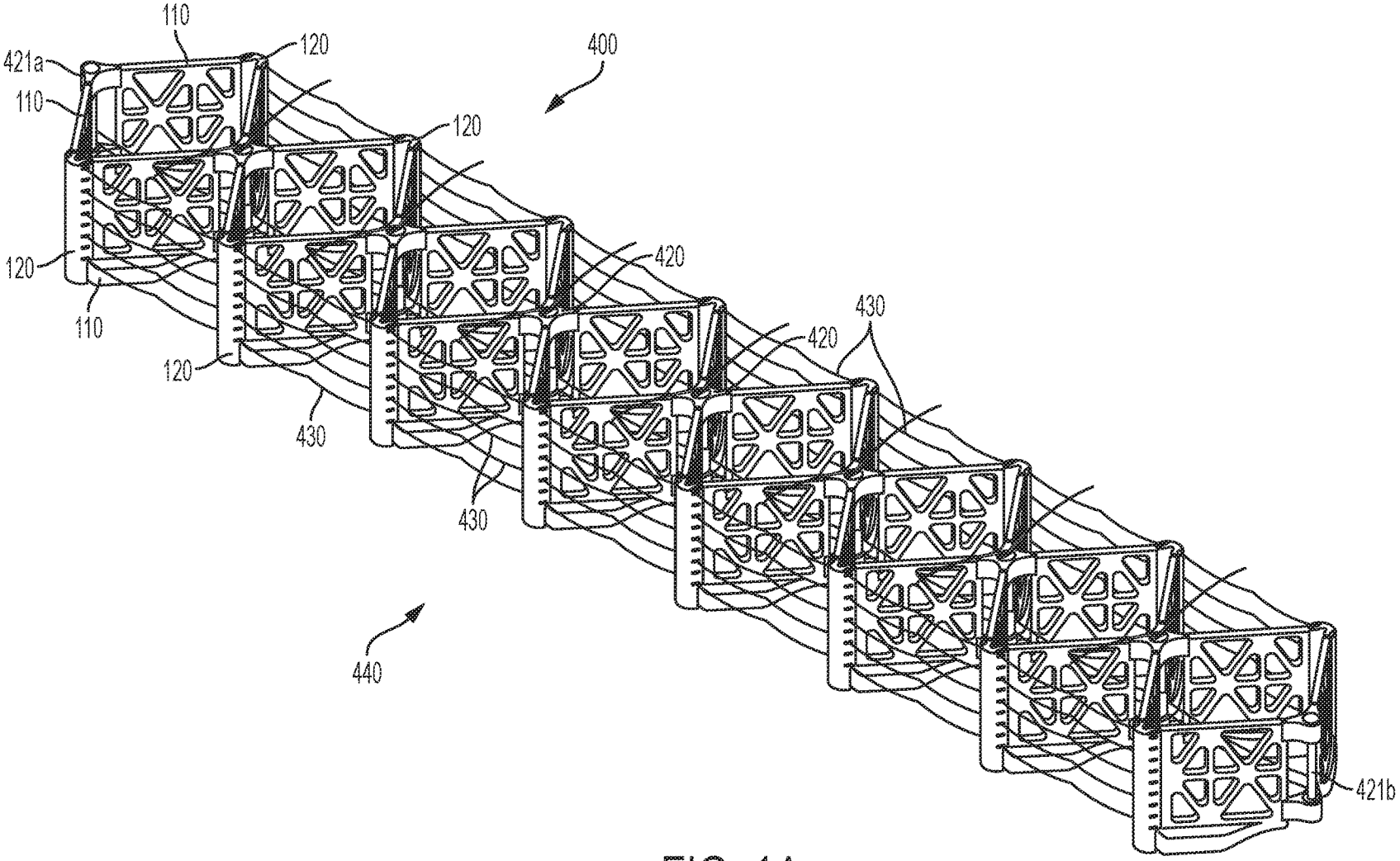
FIGS. 1*a* and 1*d* are perspective views of a marine barrier usable with the present invention.
Figure 1B:
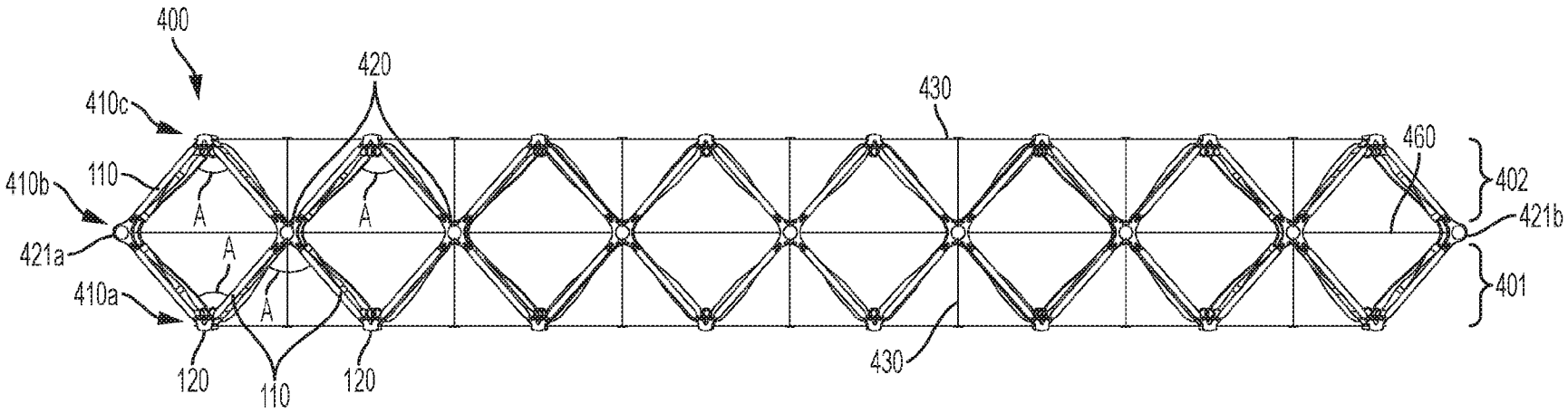
FIGS. 1*b* and 1*c* are plan views of the barrier of FIGS. 1*a* and 1*d*.
Figure 1C:
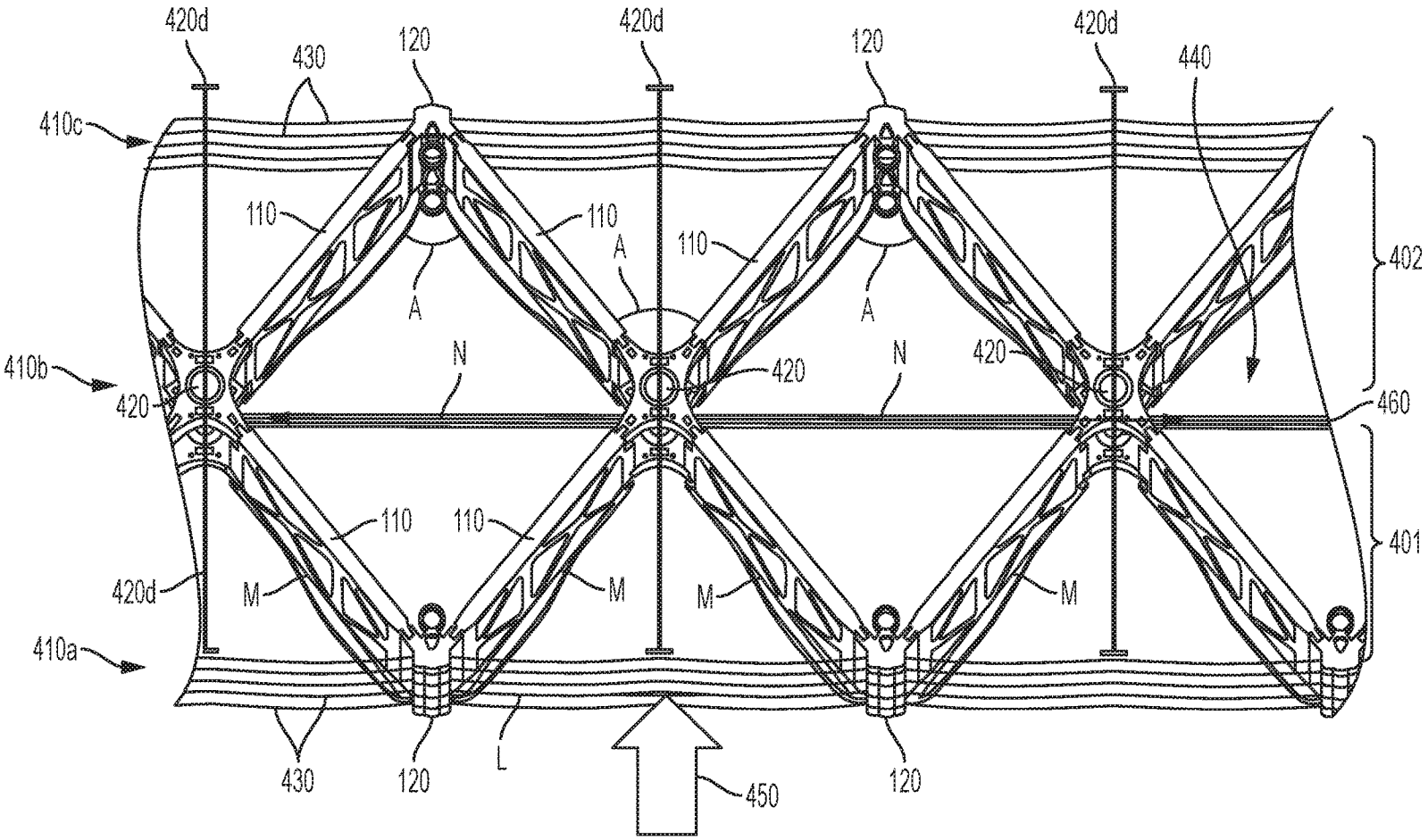
Figure 1D:
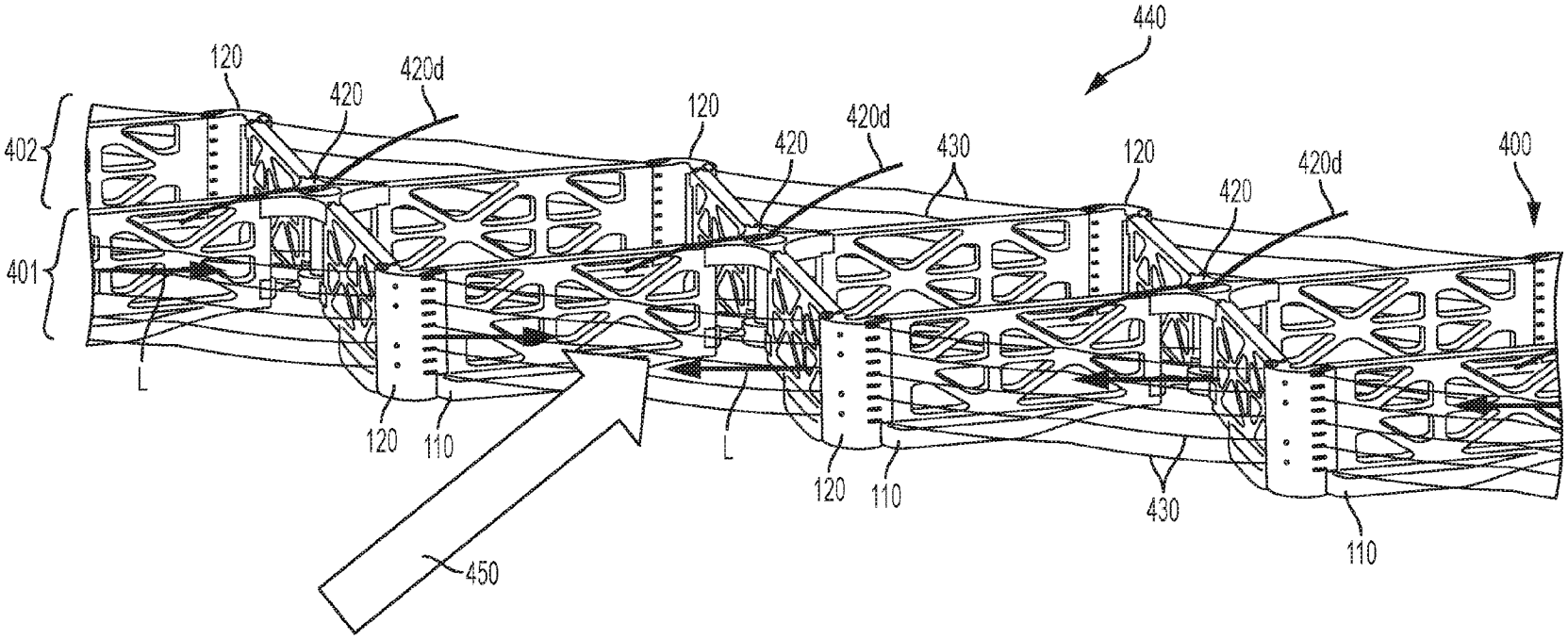
Figure 2A:
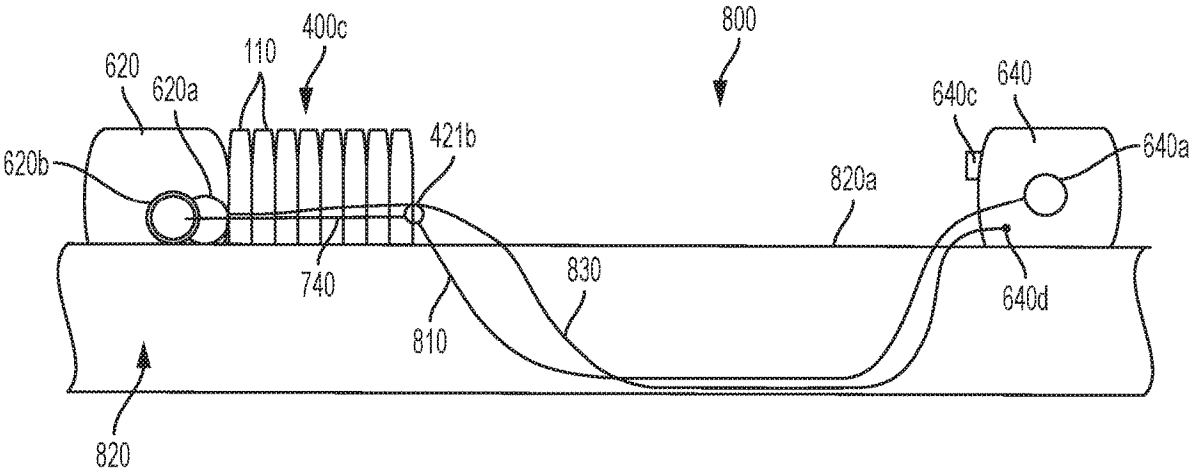
FIGS. 2*a-d* diagrammatically illustrate a prior art marine barrier gate operation.
Figure 2B:
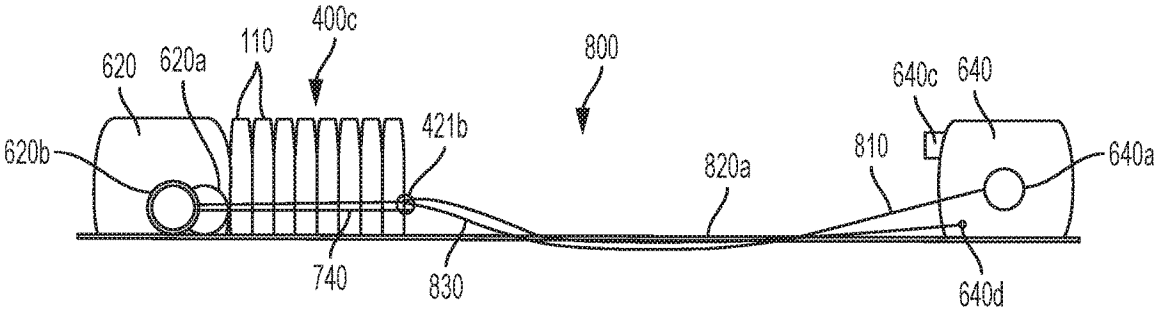
Figure 2C:
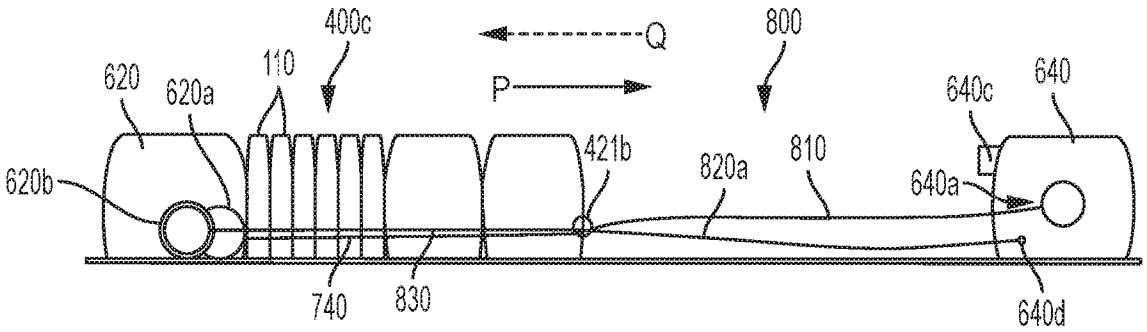
Figure 2D:
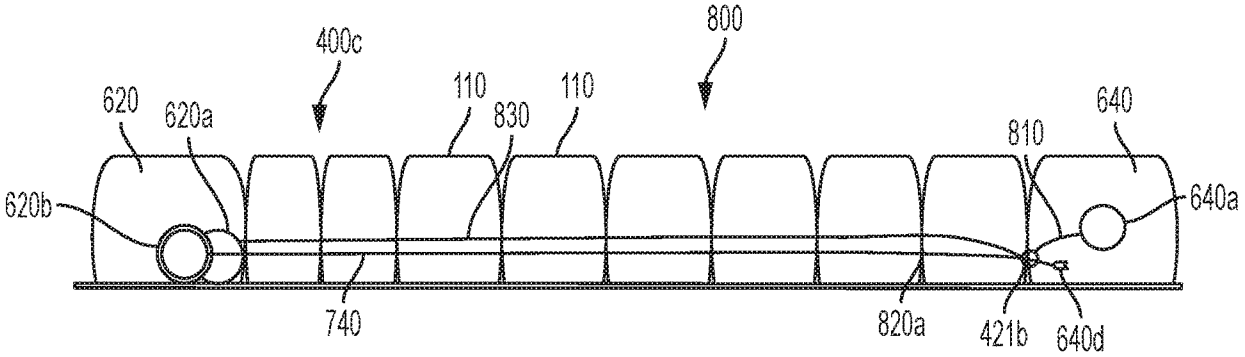
Figure 4:
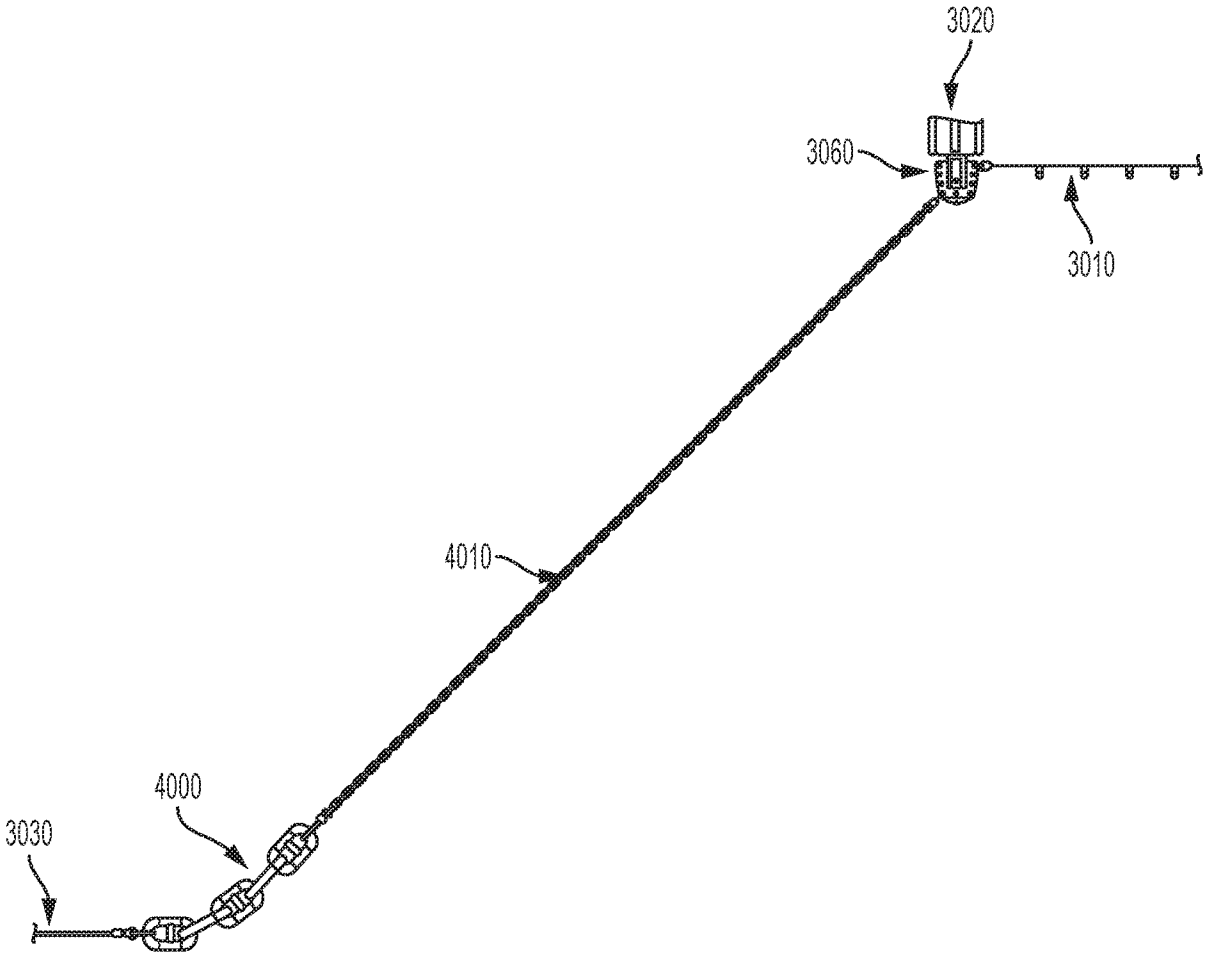
FIG. 4 illustrates a closing line according to the present disclosure.

Weight 3040 can be lumped on the closing line 3030, or can be rigidly attached in-line of the closing line 3030. In certain embodiments, as shown in FIG. 4, a clump weight 4000 is secured to the closing line 3030. A second length of chain 4010 connects to the barrier 3020. However, chain 4010 may instead be a cable, if desired. The closing cable 3030 is attached to the leading nose of the barrier at attachment point 3060, either the foremost or adjacent center column 421*b*, for example, as shown in FIG. 1*a*. The place of attachment of the clump weight 4000 is set by understanding the deployment site, environmental conditions, and required position of the cable in the water column. The weight is typically heavier than the length of the closing cable 3030 (by a minimum of two times the weight of the cable 3030 that spans the channel).

The weight 4030 can be fixed in-line of the closing line 3030, such as by the use of chain as shown in FIG. 4, or ride along the closing line 3030 via a fairlead or rolling sheave assembly 5000 as shown in FIG. 5. The sheave assembly 5000 is commercially available, off the shelf technology. The rollers 510 engage the closing line 3030 so the assembly 5000 slides on the closing line 3030. The weight (not shown) is suspended from the assembly 5000 by a tether 5020. The moving weight/sheave assembly 5000 is tethered to the barrier 3020 via a tether 5030 to limit the motion of the sheave assembly 5000 relative to the closing line 3030. The sheave assembly 5000 could instead be tethered to other sheave assemblies as required. Alternatively, sheave assembly 5000 is caused to stop at various positions by stops built into the closing line 3030. The sheave assembly 5000 is supported by flotation 5040 to keep it upright, or can be inverted and weighted if desired. In operation, the sheaves 5010 roll along the closing line 3030, supporting the clump weight as it travels. As the closing cable 3030 continues to pay out, the tethers 5030 will limit the motion of the sheave assembly 5000, thus positioning the clump weight as required for the particular deployment site.

Figure 3A:
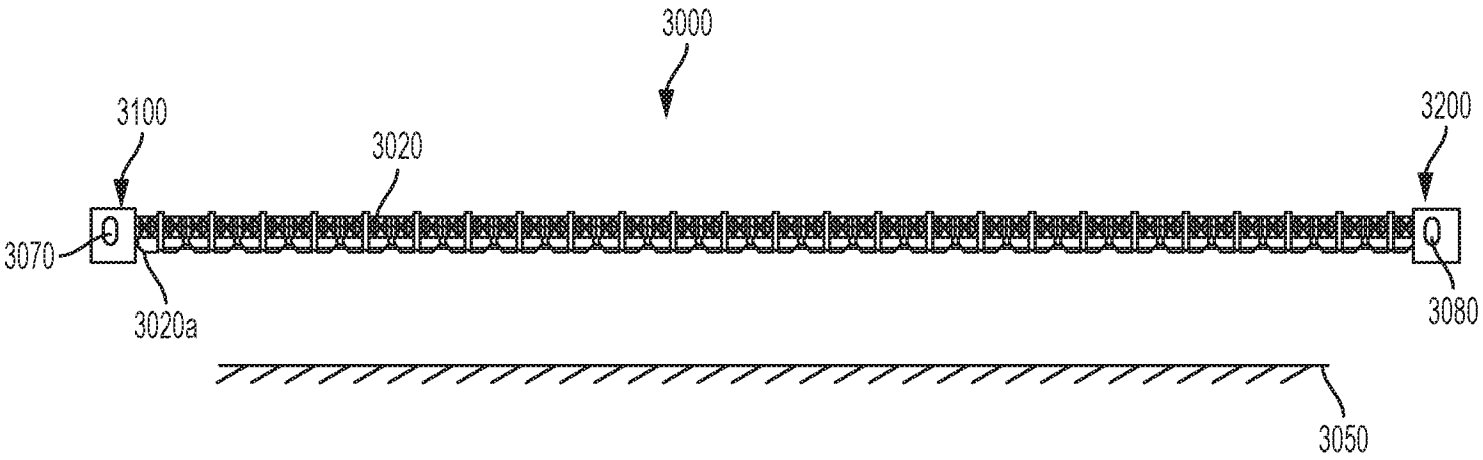
FIGS. 3*a-g* illustrate a marine gate according to an embodiment of the present disclosure, and its operation.
Figure 3B:
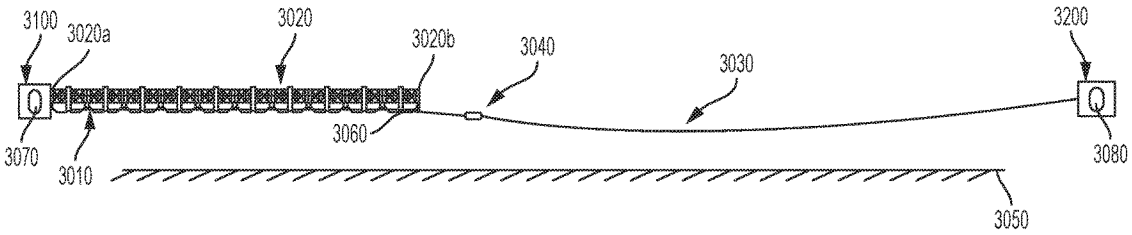
Figure 3C:
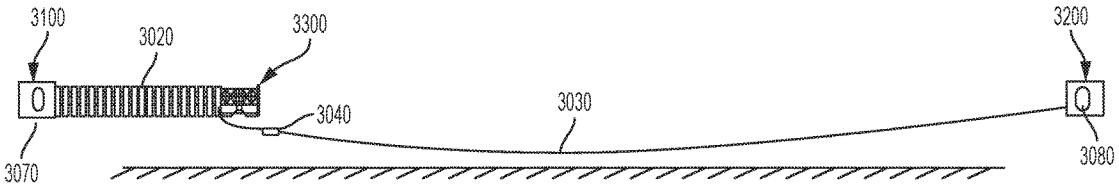
Figure 3D:
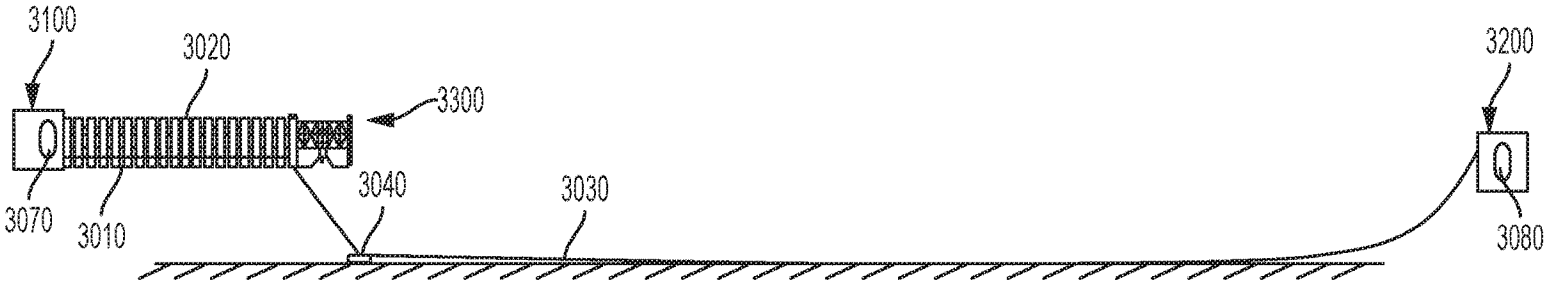

Operation of the disclosed marine gate to move barrier 3020 from the expanded position to a retracted position will now be described with reference to FIGS. 3*a-g*. FIG. 3*a* shows the barrier 3020 in the fully expanded position. The gate is ready to be retracted. In FIG. 3*b*, the opening winch 3070 pays in the opening line 3010, retracting the barrier 3020 towards the first attachment point 3100 while the closing winch 3080 pays out the closing line 3030. FIG. 3*c* shows the barrier 3020 fully retracted (i.e., the gate fully open) at position 3300 while the closing winch 3080 continues to pay out the closing line 3030 and the weight 3040 sinks. In FIG. 3*d*, the closing winch 3080 has payed out closing line 3030 until the weight 3040 has sunk to the bottom of the body of water and the submerged portion of closing line 3040 has also moved to the bottom.

Figure 3E:
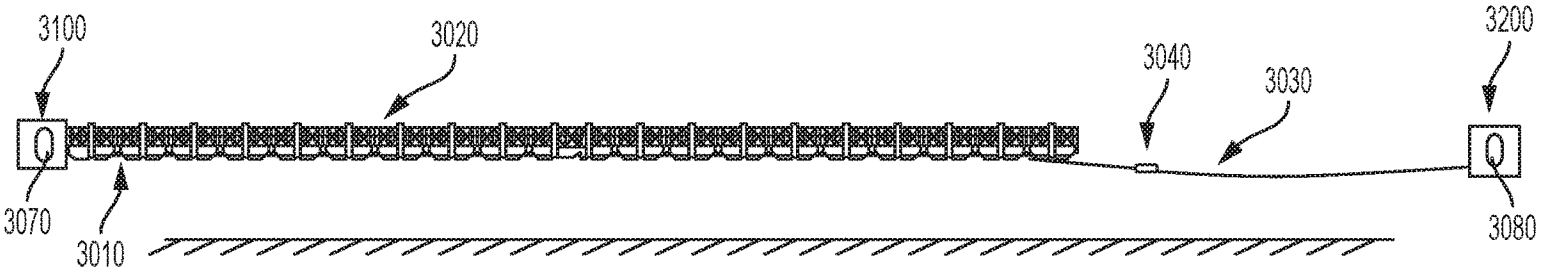
Figure 3F:
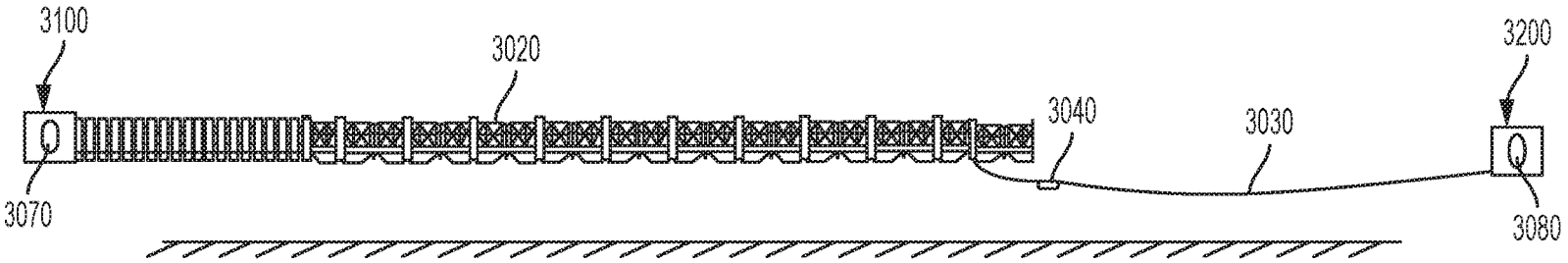
Figure 3G:
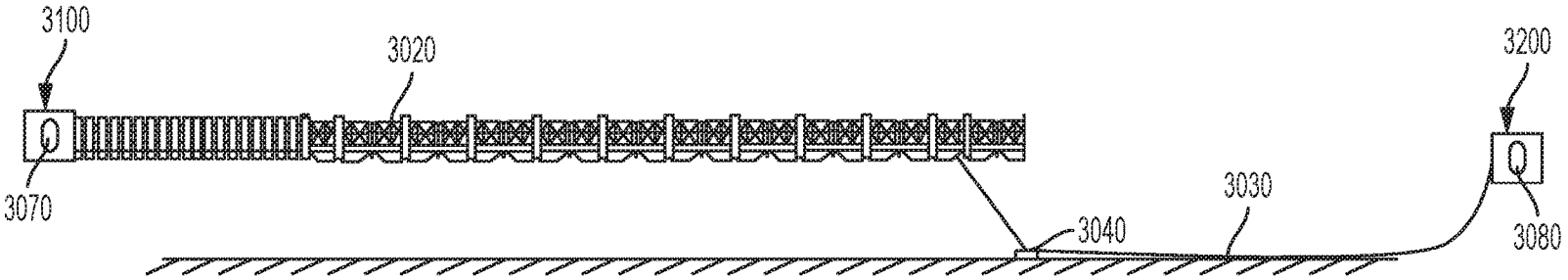

FIGS. 3*e-g* illustrate an embodiment where the gate 3000 is partially opened. In FIG. 3*e*, the opening winch 3070 has started to pay in the opening line 3010, retracting the barrier 3020 towards the first attachment point 3100 while the closing winch 3080 pays out the closing line 3030. FIG. 3*f* shows the barrier 3020 partially retracted (i.e., the gate partially open) at position 3400 while the closing winch 3080 continues to pay out the closing line 3030 and the weight 3040 sinks. In FIG. 3*g*, the closing winch 3080 has payed out closing line 3030 until the weight 3040 has sunk to the bottom of the body of water and the submerged portion of closing line 3040 has also moved to the bottom.

The steps to close (i.e., expand) the gate are the reverse, regardless of whether the gate has been partially or fully opened. The closing winch 3080 pays in the closing line 3030 until the weight 3040 and the closing line 3030 rise to the surface of the body of water, and then continues to pay in the closing line 3030 while the opening winch 3070 pays out the opening line 3010 and the barrier 3020 expands; e.g., until it is in the fully expanded position of FIG. 3*a*.

In further embodiments, an example of which is shown in FIGS. 6*a-c*, the disclosed marine gate 6000 is opened and closed using two lines 3010, 6010 with distributed clumped weights 6020 instead of a single clumped weight. In these embodiments, the barrier gate 3020 can be opened fully or partially. The weights 6020 can be connected in line, as in the embodiments of FIGS. 3*a-g* and 4, or placed on a series of sheave assemblies 5000, as shown in FIG. 5. The size and number of the weights 6020 determine the cable position in the water column. The weights 6020 can be separate or integrated into the closing cable 6010 via extrusion or jacketing processes. The position of each weight 6020 is adjusted to allow the weight to rest on the seafloor in a variety of environmental conditions and water depths specific for the deployment site. In embodiments where the weights 6020 are movably attached to the closing line using a plurality of sheave assemblies 5000 of FIG. 5, the length of the tethers 5030 can be similar throughout the system or different lengths to obtain a specific weight distribution.

The operation of gate 6000 is otherwise the same as the operation of gate 3000 of FIGS. 3*a-g*. For example, in FIG. 6*a*, the opening winch 3070 pays in the opening line 3010, retracting the barrier 3020 towards the first attachment point 3100 while the closing winch 3080 pays out the closing line 6010. FIG. 6*b* shows the barrier 3020 fully retracted (i.e., the gate fully open) at position 3300 while the closing winch 3080 continues to pay out the closing line 6010 and the weights 6020 sink. In FIG. 6*c*, the closing winch 3080 has payed out closing line 6010 until the weights 6020 have sunk to the bottom of the body of water and the submerged portion of closing line 6010 has also moved to the bottom. The steps to close (i.e., expand) the gate are the reverse, regardless of whether the gate has been partially or fully opened.

Figure 7:
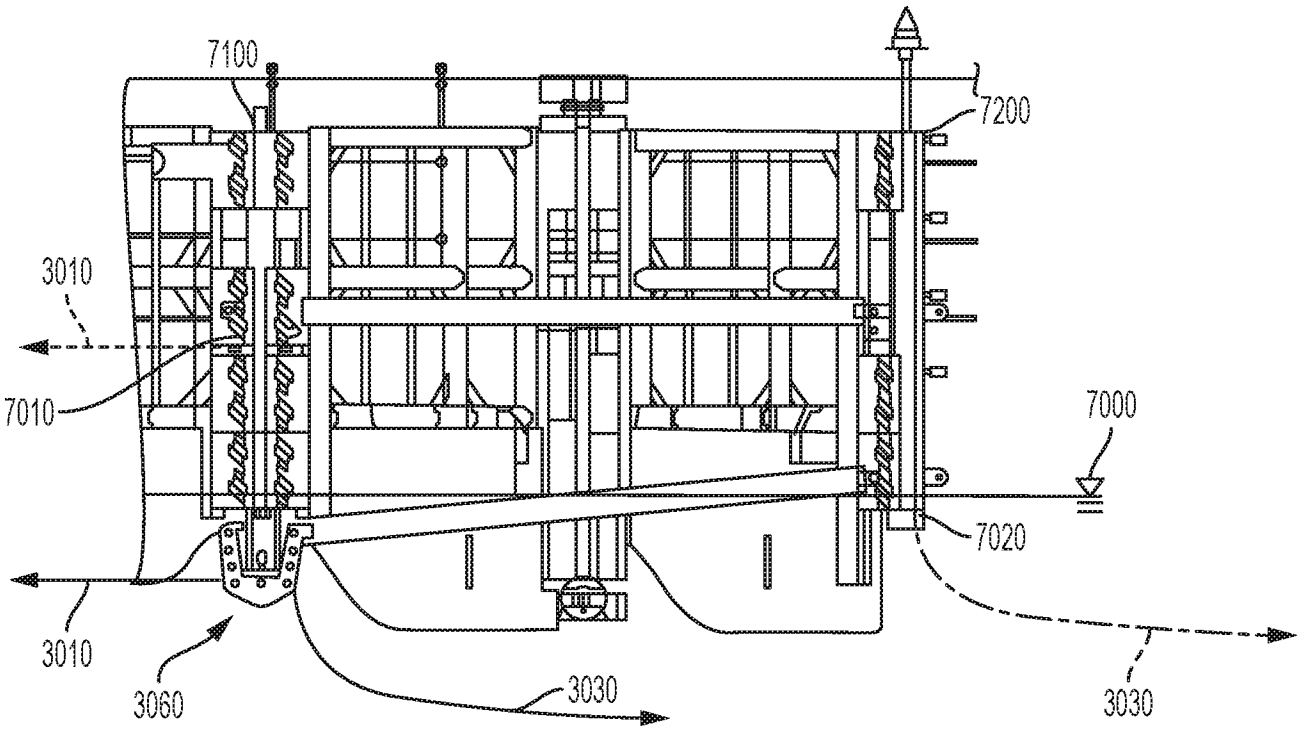
FIG. 7 illustrates the connection of opening and closing lines to a barrier gate according to an embodiment of the disclosure.

FIG. 7 illustrates a configuration of how the opening and closing lines are connected to the barrier 3020. The opening line 3010 is connected to either the leading end column 7200 or the adjacent column 7100; for example, at attachment point 3060. It can be connected to a subsurface location or above the water surface 7000 with minimal change to the gate operations and system dynamics. In the alternative, opening line 3010 can be attached to a different point 7010 on the column 7100. The closing line 3030 can be attached to either of the discussed columns and positions on the columns; for example, attachment point 3060 or a different attachment point 7020 on leading end column 7200.

RFID Cable

Figure 8A:
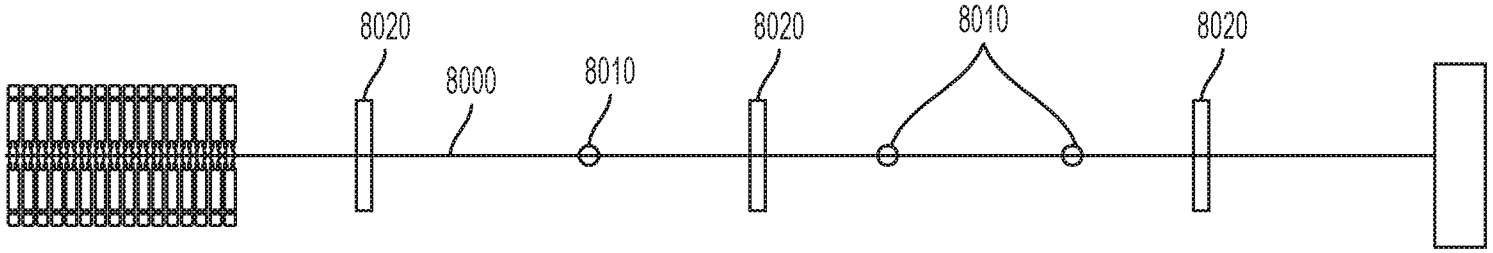
FIGS. 8*a-b* illustrate a marine gate according to the present disclosure having RFID sensors and antennas to determine cable position.

A closing line 8000 that extends into the water column can also have integrated sensors 8010, such as conventional RFID sensors as shown in FIG. 8*a*, allowing the position of the closing line 8000 to be determined. Antenna/RFID readers 8020 are located in the water column at a prescribed depth, such that when the sensors 8010 in the line 8000 come within reading distance, a signal is generated and the position of the line 8000 is known.

Figure 8B:
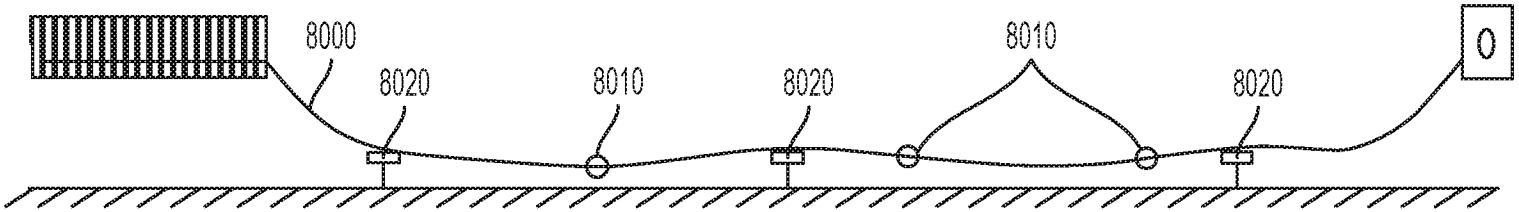

FIG. 8*b* illustrates the how the closing line position can be determined if it is outfitted with RFID sensors 8010 in specific locations or throughout the closing line 8000. Once the gate is opened (collapsed) as shown in FIGS. 8*a-b*, the closing line 8000 is payed out, dropping the closing line 8000 to the seafloor. RFID antennas 8020 are placed on the seafloor. Once the cable 8000 comes within range of the antennas 8020, the system is notified that the cable 8000 is in position. This in turn notifies the end users that the channel can be safely navigated. The RFID sensors 8010 can be extruded into a jacket of the cable 8000, or attached separately. The cable 8000 is also used to close the gate when needed. The RFID sensors 8010 are also sized/designed to be wrapped on a drum of a winch (or the equivalent).

The RFID-equipped cable 8000 is reinforced to be load rated, and can sustain steady state and impact forces associated with the marine gate. The cable 8000 is negatively buoyant, either by design or employment of lumped or distributed weights as discussed herein above with reference to FIGS. 3*a* and 6*a*, such that it will tend to sink and/or rest on the seafloor.

The RFID sensors 8010 can be epoxied into the cable/line 8000 or injected during the extrusion process. If polymer or synthetic line is employed, the sensors 8010 can be placed inside the line.

Cable Pull-Down Methods

FIGS. 9*a* thru 13*d* illustrate a cable management configuration where the closing cable is drawn to the seafloor via a pair of separate winches, called "down winches" as shown in FIGS. 11*a-b* and 12*a-c*, and return the gate to a closed position as shown in FIGS. 13*a-d*. This cable management configuration pulls the closing cable to the seafloor, under tension, and by understanding the position of the line on the down-winches, the operators can fully understand the position of the closing line in the water column and across the channel at all times, significantly improving the efficiency and operational confidence of the gate system.

Figure 10:
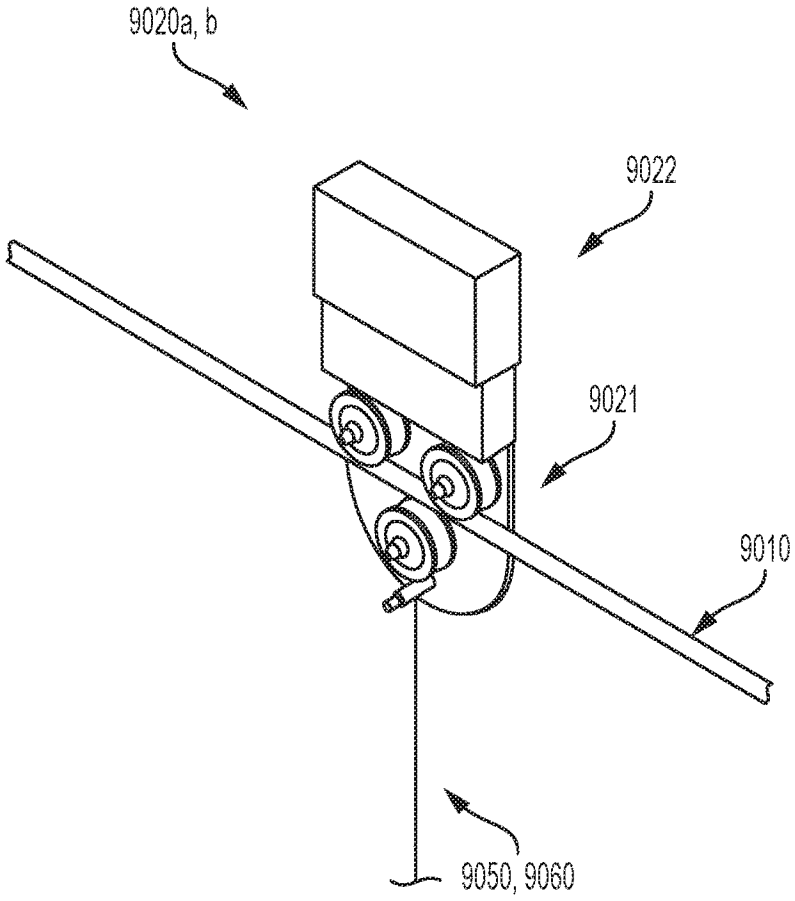
FIG. 10 illustrates a rolling sheave for usable with the embodiment of the present disclosure of FIGS. 9*a-b*, 11*a-b*, 12*a-c* and 13*a-d*.
Figure 12A:
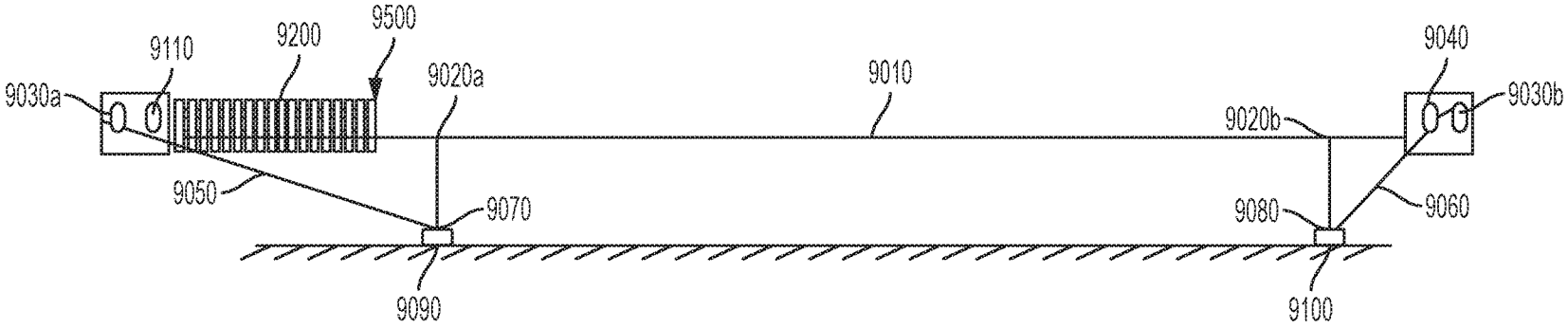
Figure 12B:
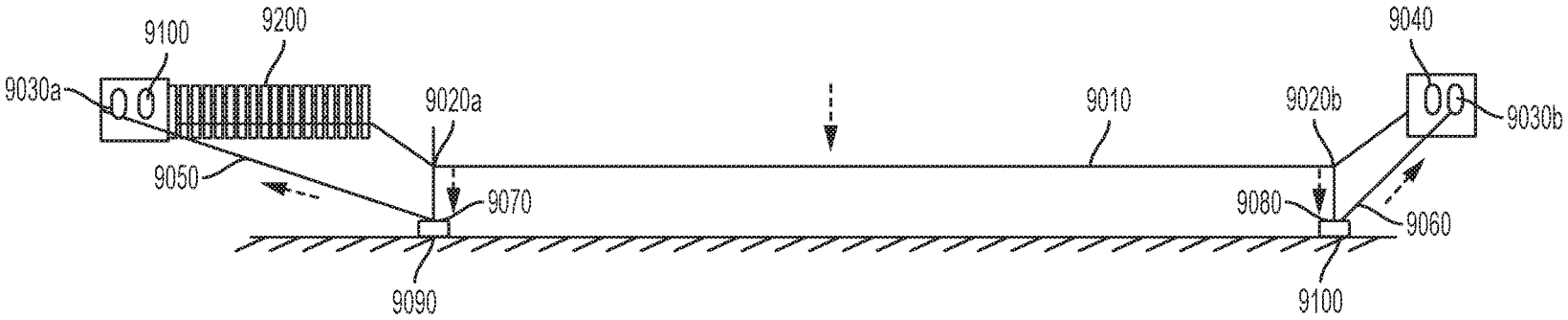
Figure 12C:
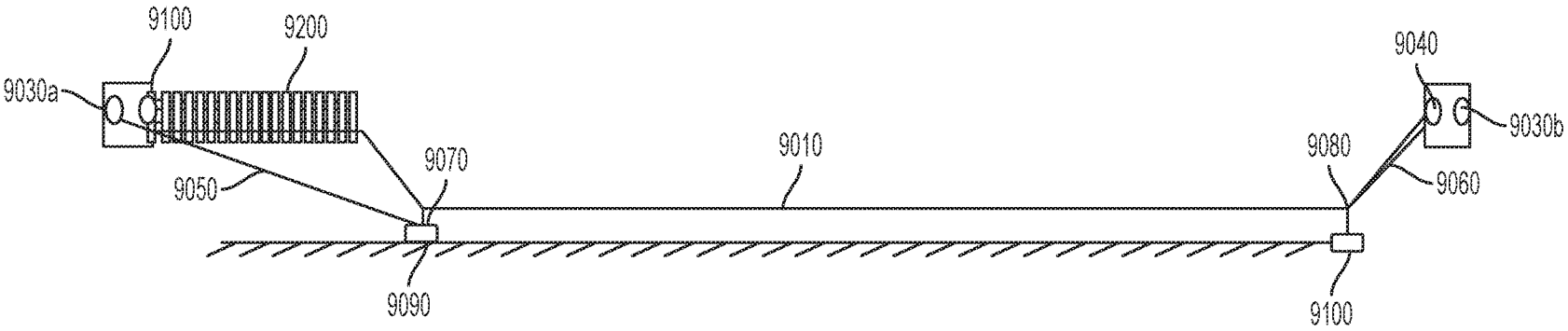
Figure 13A:
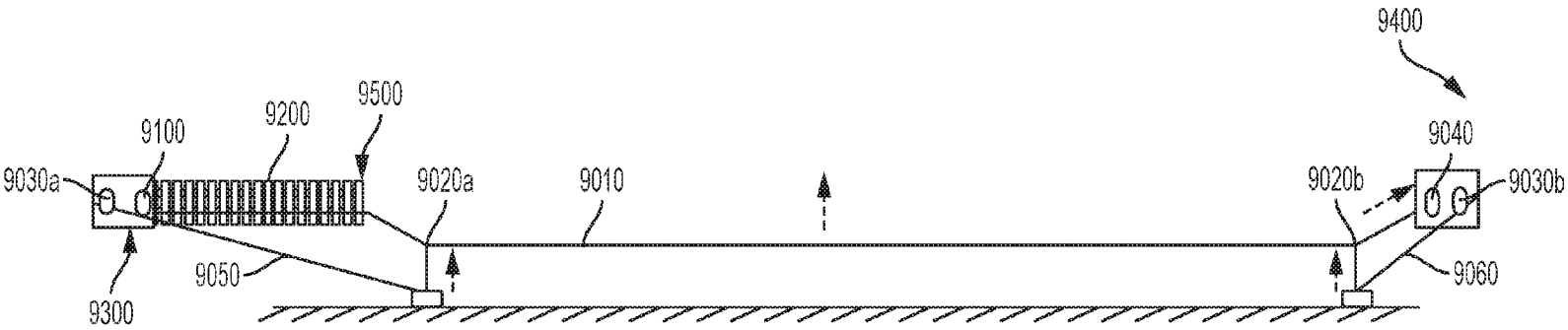
Figure 13B:
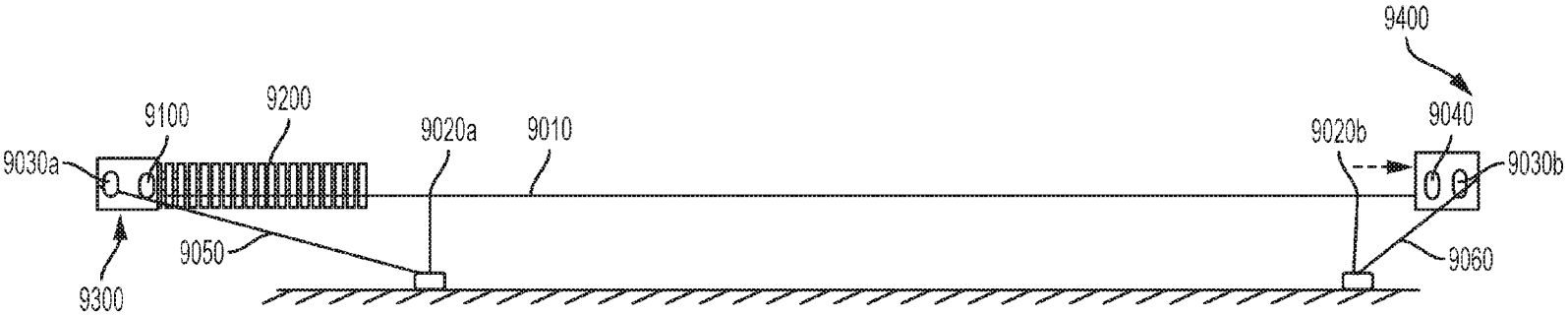
Figure 13C:
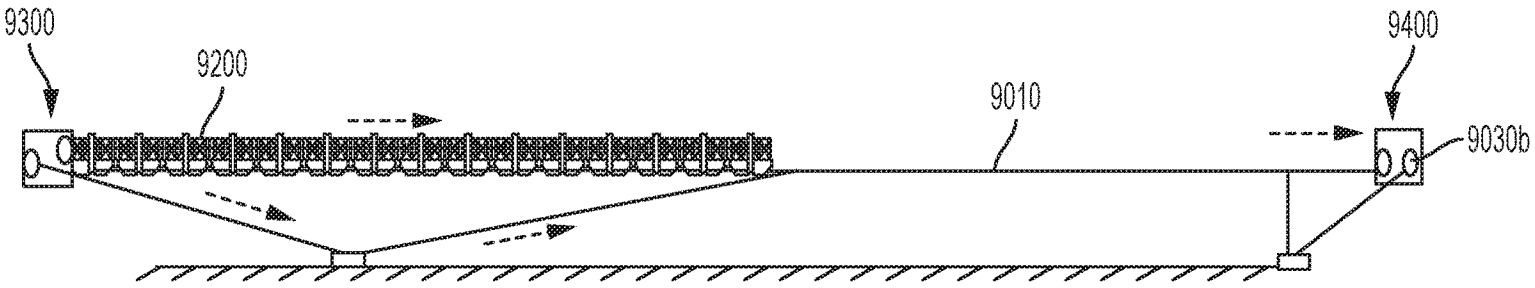
Figure 13D:
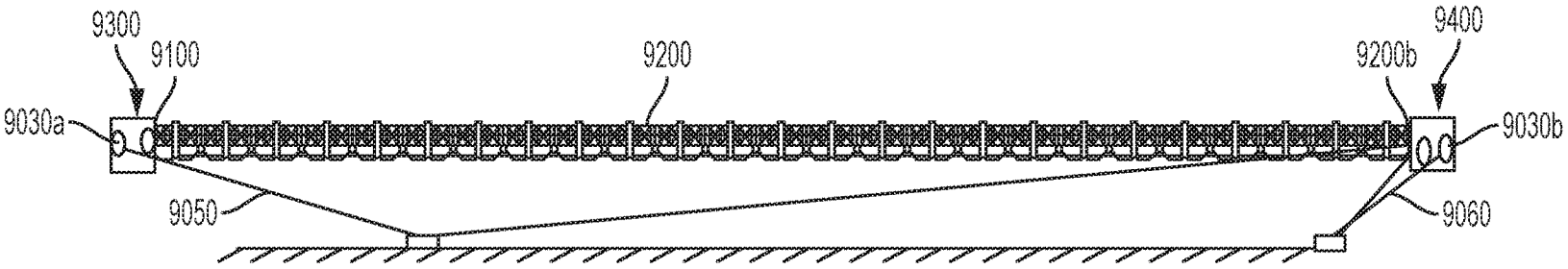

In one embodiment, the main closing cable 9010 is pulled to the seafloor as shown in FIGS. 12*a-c*, via rolling fairleads/sheave assemblies 9020 of FIG. 10 and down winches 9030*a*, 9030*b*. The closing line 9010 is pulled off the closing winch 9040 with back tension, allowing the closing cable 9010 to be under tension. By monitoring the line payout of the down winches 9030*a*, 9030*b*, the position of the closing line 9010 is known.

Figure 9A:
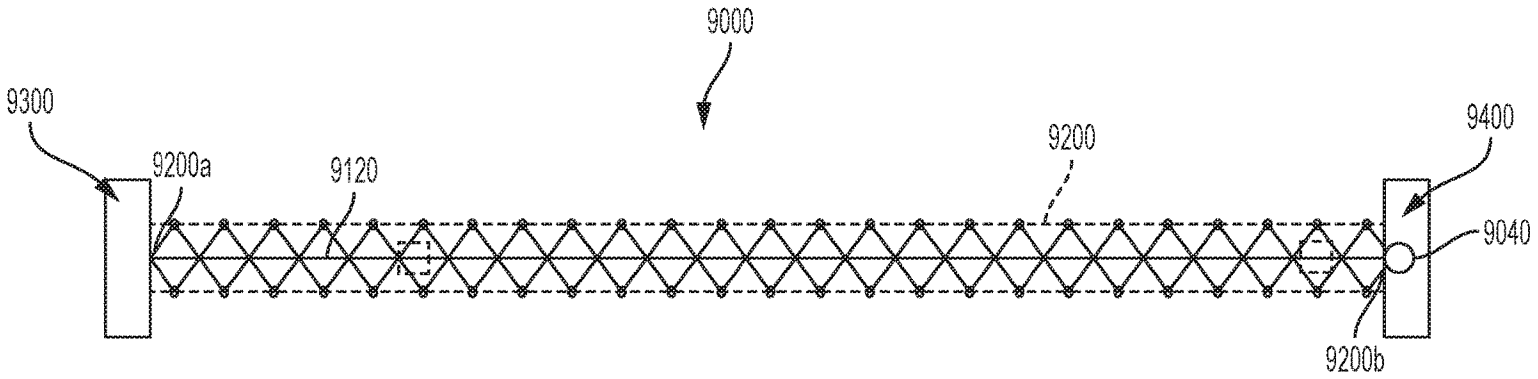
FIGS. 9*a-b*, 11*a-b*, 12*a-c* and 13*a-d* illustrate a marine gate according to another embodiment of the present disclosure wherein a closing line is drawn to the seafloor via winches, and its operation.
Figure 9B:
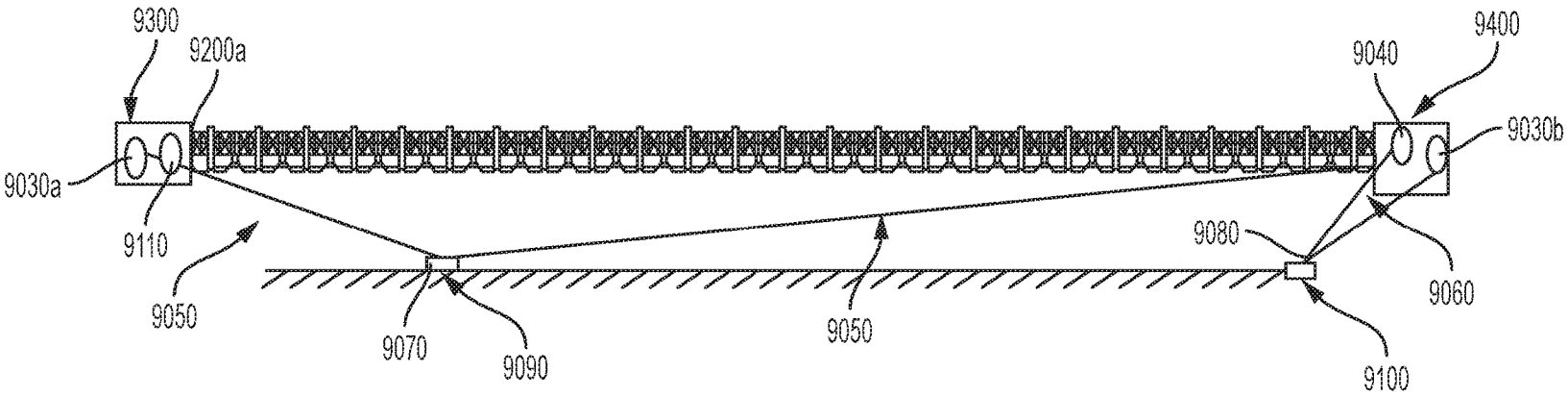

FIGS. 9*a-b* show the gate 9000 in a closed (fully expanded) position, and the arrangement of the two additional lines 9050, 9060 attached to down winches 9030*a-b*. The gate 9000 is opened and closed via an opening line and a closing line, as described with reference to FIGS. 3*a-d* and FIGS. 6*a-c*. However, in place of weight(s), the closing line is brought to the seafloor via down winches 9030*a-b*. These winches are connected to pull-down lines 9050, 9060 that run through pulleys 9070, 9080 connected to subsurface blocks 9090, 9100, and are then attached to sheave assemblies 9020 that ride on the closing line 9010 of FIG. 10.

In an embodiment shown in FIGS. 9*a*-13*d*, a marine gate 9000 according to the present disclosure comprises a buoyant variable length barrier gate 9200, such as shown in FIGS. 1*a-d* and described above and in U.S. Pat. No. 8,739,825. When the barrier gate 9200 is floating in a body of water, the barrier gate 9200 is movable from a fully expanded position shown in FIGS. 9*a-b*, where the barrier gate 9200 extends from a substantially stationary first attachment point 9300 to a substantially stationary second attachment point 9400 remote from the first attachment point 9300, to a retracted position shown in FIG. 12*a*, where the barrier gate 9200 extends from the first attachment point 9300 to a location 9500 between the first and second attachment points 9300, 9400.

The first attachment point 9300 is attached to a proximal end 9200*a* of the barrier gate 9200. An opening winch 9110 is disposed at the first attachment point 9300, and has an opening line 9120 which is attached proximal to a free end 9200*b* of the barrier gate 9200 opposite the proximal end 9200*a* of the barrier gate 9200. This attachment point is shown as reference numeral 9130 in FIG. 11*a*. The opening line 9120 is movably supported by the barrier gate 9200 between the first attachment point 9300 and the free end 9200*b* of the barrier gate 9200. Opening line 9120 is for moving the barrier gate 9200 from the fully expanded position shown in FIG. 9*a* to the retracted position 9500 by operation of the opening winch 9110.

A closing winch 9040 is disposed at the second attachment point 9400, the closing winch 9040 having a closing line 9010 attached proximal to the free end 9200*b* of the barrier gate 9200; e.g., at attachment point 9130. The closing line 9010 is for moving the barrier gate 9200 from the retracted position 9500 to the fully expanded position by operation of the closing winch 9040.

A first down winch 9030*a*, located at the first attachment point 9300 and having a first pull-down line 9050 in engagement with the closing line 9010, is disposed proximal the free end 9200*b* of the barrier gate 9200. A second down winch 9030*b*, located at the second attachment point 9400, has a second pull-down line 9060 in engagement with the closing line 9010 proximal the second attachment point 9400.

The marine gate 9000 further comprises a first mooring point 9090 (e.g., a mooring block) having a pulley 9070 disposed at the bottom of the body of water between the first and second attachment points 9300, 9400, and a first rolling sheave assembly 9020*a* (as shown in FIG. 10) for engaging the closing line 9010 and the first pull-down line 9050 to slidably mount the first pull-down line 9050 to the closing line 9010. The first pull-down line 9050 extends from the first down winch 9030*a*, through the pulley 9070 of the first mooring point 9090, to the first rolling sheave assembly 9020*a*.

The marine gate 9000 further comprises a second mooring point 9100 (e.g., a mooring block) having a pulley 9080 disposed at the bottom of the body of water between the first and second attachment points 9300, 9400, and a second rolling sheave assembly 9020*b* for engaging the closing line 9010 and the second pull-down line 9060 to slidably mount the second pull-down line 9060 to the closing line 9010. The second pull-down line 9060 extends from the second down winch 9030*b*, through the pulley 9080 of the second mooring point 9100, to the second rolling sheave assembly 9020*b*.

The first and second mooring points 9070, 9080 are disposed between the second attachment point 9400 and the free end of the barrier gate 9200*b* when the barrier gate is in the retracted position 9500.

The first and second down winches 9030*a*, 9030*b* are disposed for respectively paying in the first and second pull-down lines 9050, 9060 to move a submerged portion of the closing line 9010 to be proximal to the bottom of the body of water when the barrier gate 9200 is in the retracted position 9500 and the closing line 9010 is payed out by operation of the closing winch 9040. The closing winch 9040 is for tensioning the closing line 9010 when the barrier gate 9200 is in the retracted position 9500 and the first and second down winches 9030*a*, 9030*b* move the submerged portion of the closing line 9010.

The fairlead or rolling sheave assembly 9020*a, b* is shown in FIG. 10. The sheave assembly 9020*a, b* is commercially available, off the shelf technology, similar in most respects to sheave assembly 5000 shown in FIG. 5. The rollers 9021 engage the closing line 9010 so the assembly 9020*a, b* slides on the closing line 9010. A pull-down line 9050, 9060 is connected to the assembly 9020*a, b*. The moving sheave assembly 9020*a-b* is supported by flotation 9022 to keep it upright, or can be inverted and weighted if desired. In operation, the sheaves 9021 roll along the closing line 9010, moving the pull-down line 9050, 9060 as it travels.

Figure 11A:
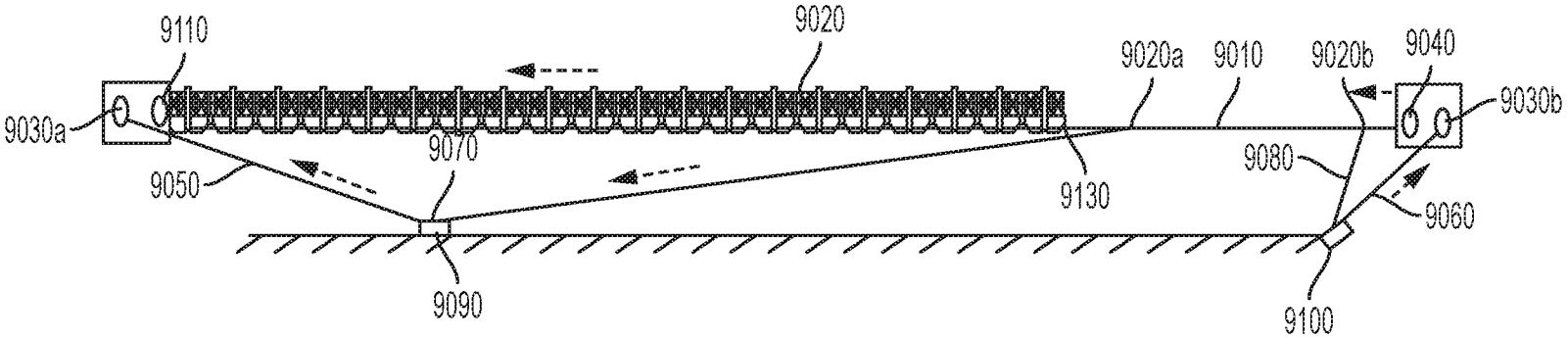
Figure 11B:
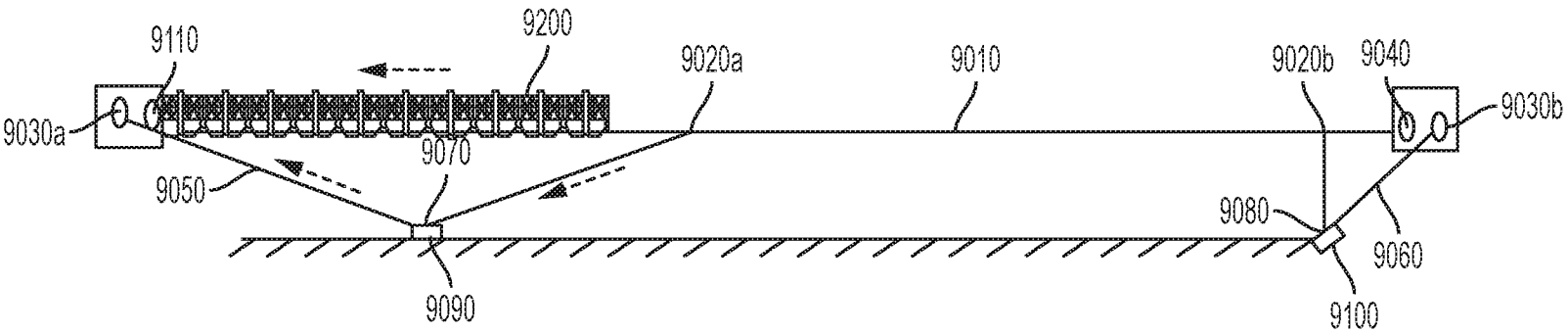

In operation, the opening winch 9110 pulls on the opening line 9120 and retracts the barrier gate 9200, as shown in FIGS. 11*a-b*. The closing winch 9040 pays out the closing line 9010 under back tension. Once a preset amount of cable has been taken off the closing winch 9040, the down winches 9030*a-b* engage, bringing the snatch blocks (sheave assemblies) 9020*a-b* across the water column, and then driving the closing line 9010 to the seafloor as shown in FIGS. 12*a-c* when the barrier 9200 is in the retracted position 9500. The closing line 9010 is pulled off the closing winch 9040 under tension. By monitoring the tension and cable length, the location of the closing line 9010 is known.

To close the gate, the operation is reversed, as shown in FIGS. 13*a-d*. The down-winches 9030*a-b* pay out line, allowing the closing winch 9040 to draw up the pull-down lines 9050, 9060 under tension (see, FIGS. 13*a-b*). Once the closing line 9010 is near the surface, the closing winch 9040 begins to pull the barrier 9200 closed, pulling line off the opening winch 9110 and down winches 9030*a-b*. The sheave assemblies 9020*a-b* are pushed along the closing cable 9010. The closing winch 9040 then pulls the barrier 9200 across the channel, while the snatch blocks 9020*a-b* are "pushed" along closing line 9010 (see, FIGS. 13*c-d*). Once the gate is closed, the sheave assemblies 9020*a-b* that travel on the closing line 9010 are adjacent to the second attachment point 9400 and the leading edge 9200*b* of the barrier 9200.

In further embodiments, the closing cable is pulled down mechanically off a fixed structure as shown in FIG. 14. The two-cable, two-winch gate opening and closing operation is the same as in the embodiment of FIGS. 9*a*-13*d* described above. However, instead of down winches and pull-down cables, first and second push-down mechanisms such as a pair of taut cables, pipes or level arms are lowered below the water column, forcing the closing cable to be under tension. The location of the closing cable is known at all times due to the line tension and position of the mechanical system. In one embodiment, the closing cable is driven to the seafloor using a cable or rigid beam that is attached to a pair of pilings after the gate is opened.

Figure 14A:
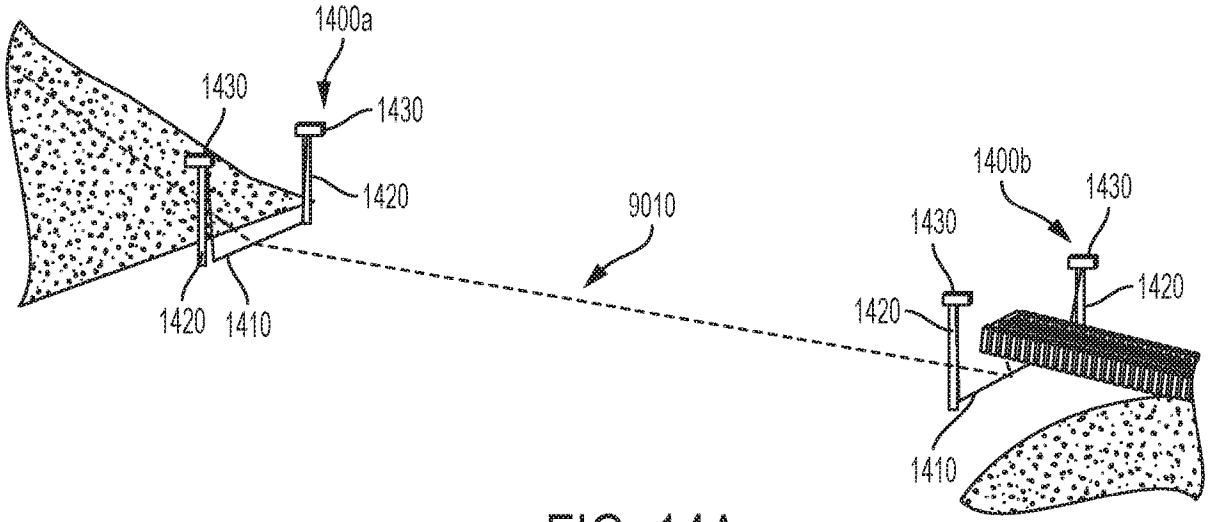
FIGS. 14*a-b* illustrates a marine gate according to another embodiment of the present disclosure wherein a closing line is drawn to the seafloor using a cable or rigid beam, and its operation.
Figure 14B:
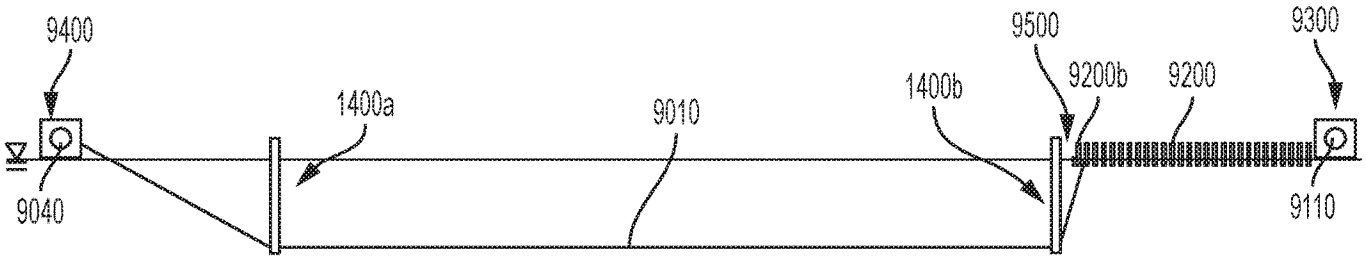

Referring now to FIGS. 14*a-b*, the barrier 9200 is opened by the opening winch 9110 to the retracted position 9500 as described herein above with reference to FIGS. 9*a*-12*a*. Then, first and second push-down mechanisms 1400*a*, 1400*b*, spaced apart from each other and disposed between the second attachment point 9400 and the free end 9200*b* of the barrier gate 9200, engage the closing line 9010 to move a submerged portion of the closing line 9010 to be proximal to the bottom of the body of water, as the closing line is payed out by operation of the closing winch 9040.

The closing winch 9040 tensions the closing line 9010 when the barrier gate 9200 is in the retracted position 9500 and the first and second push-down mechanisms 1400*a, b* move the submerged portion of the closing line.

The first and second push-down mechanisms 1400*a, b* each comprise a substantially horizontal taut cable, pipe or rigid beam 1410 for engaging the closing line 9010, and at least one substantially vertical piling (e.g., a pair of pilings 1420) anchored to the bottom of the body of water. The taut cable, pipe, or rigid beam 1410 is movable along a length of the piling 1420 to push the closing line 9010 toward the bottom of the body of water. In certain embodiments, a pair of winches 1430 are mounted to the pilings 1420, respectively, and operatively connected to the taut cable, pipe or rigid beam 1410 for moving the closing line 9010 toward the bottom of the body of water. Winches 1430 can be conventional electric winches known to those of skill in the art, such as truck winches, which are payed out and allow the weight of the horizontal beam or pipe 1410 to push down the closing line 9010, and are thereafter payed in to lift the beam or pipe 1410 up when the barrier gate 9200 is to be closed.

Bi-Directional Gate Operation

Figure 15A:
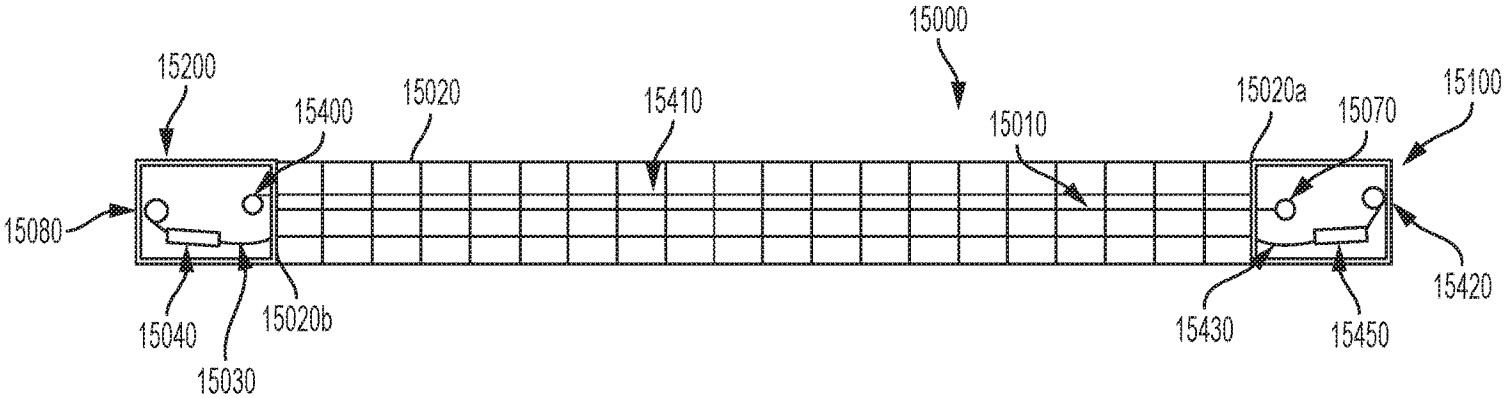
FIGS. 15*a-c* illustrates a marine gate according to another embodiment of the present disclosure wherein the gate can be opened in either direction, and its operation.
Figure 15B:
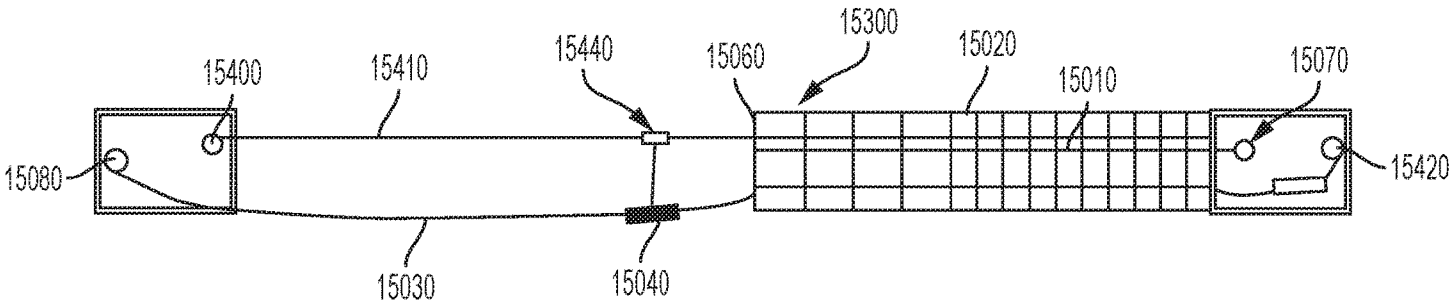
Figure 15C:
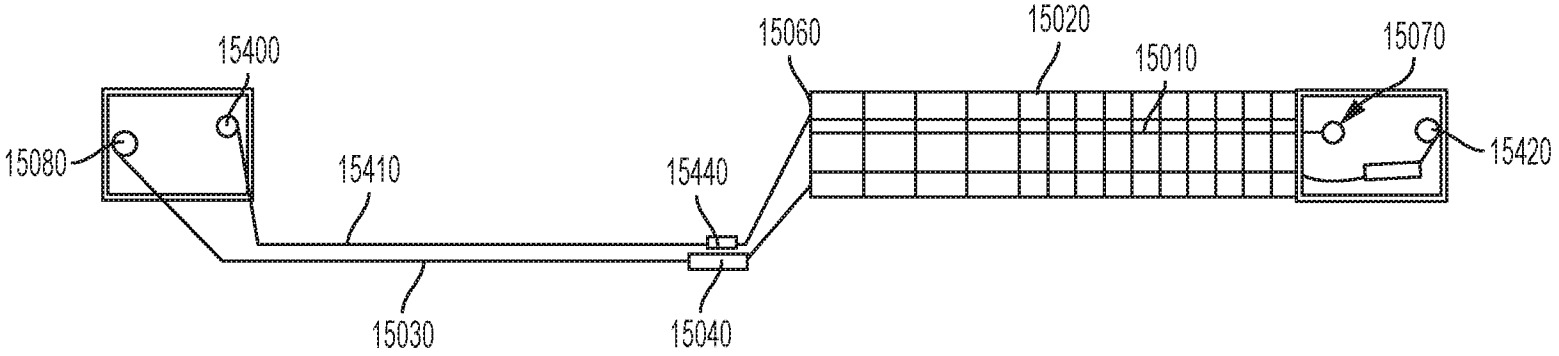

FIGS. 15*a-c* illustrate a marine barrier that allows bi-directional gate capability. In this embodiment, four (4) winches are employed, each operating/handling a cable within the system. A pair of opening winches allows the gate to be opened in either direction, as needed. A pair of closing winches likewise closes the gate in either direction. Two cables are lowered to the seafloor similarly to the embodiment described herein above with reference to FIGS. 3*a-f*, once the gate is in its fully or partially open position. A similar operation is employed to open the gate in the other direction, allowing access on both sides of the gate, as needed.

In this embodiment shown in FIGS. 15*a-c*, a marine gate 15000 similar to gate 3000 of FIGS. 3*a-g* comprises a buoyant variable length barrier gate 15020, such as shown in FIGS. 1*a-d* and described above and in U.S. Pat. No. 8,739,825. When the barrier gate 15020 is floating in a body of water, the barrier gate 15020 is movable from a fully expanded position shown in FIG. 15*a*, where the barrier gate 15020 extends from a substantially stationary first attachment point 15100 to a substantially stationary second attachment point 15200 remote from the first attachment point 15100, to a first retracted position shown in FIG. 15*b*, where the barrier gate 15020 extends from the first attachment point 15100 to a location 15300 between the first and second attachment points 15100, 15200.

The first attachment point 15100 is attached to a first end 15020*a* of the barrier gate 15020. A first opening winch 15070 is disposed at the first attachment point 15100, and has a first opening line 15010 which is attached proximal to a second end 15020*b* of the barrier gate 15020 opposite the first end of the barrier gate 15020. This attachment point is shown as reference numeral 15060 in FIG. 15*b*. The first opening line 15010 is movably supported by the barrier gate 15020 between the first attachment point 15100 and the second end 15020*b* of the barrier gate 15020. First opening line 15010 is for moving the barrier gate 15020 from the fully expanded position shown in FIG. 15*a* to the first retracted position 15300 by operation of the first opening winch 15070.

A first closing winch 15080 is disposed at the second attachment point 15200, the first closing winch 15080 having a first closing line 15030 attached proximal to the second end 15020*b* of the barrier gate 15020; e.g., at attachment point 15060. The first closing line 15030 is for moving the barrier gate 15020 from the retracted position 15300 to the fully expanded position by operation of the first closing winch 15080.

A second opening winch 15400 is disposed at the second attachment point 15200, the second opening winch 15400 having a second opening line 15410 attached proximal to the first end of the barrier gate 15020*a* for moving the barrier gate 15020 from the fully expanded position shown in FIG. 15*a* to a second retracted position (not shown) where the barrier gate 15020 extends from the second attachment point 15200 to a location between the first and second attachment points 15100, 15200. When the second opening winch 15400 operates to pay in the second opening line 15410 to move the barrier gate 15020 from the fully expanded position to the second retracted position, the first opening winch 15070 pays out the first opening line 15010. Likewise, the when the first opening winch 15070 operates to pay in the first opening line 15010 to move the barrier gate 15020 from the fully expanded position to the first retracted position 15300, the second opening winch 15400 pays out the second opening line 15410.

A second closing winch 15420 is disposed at the first attachment point 15100, the second closing winch 15420 having a second closing line 15430 attached proximal to the second end 15020*b* of the barrier gate, for moving the barrier gate 15020 from the second retracted position to the fully expanded position by operation of the second closing winch 15420.

A first weight 15040 is attached to the second opening line 15410 and the first closing line 15030 for moving the second opening line 15410 and a submerged portion of the first closing line 15030 to the bottom of the body of water when the barrier gate 15020 is in the first retracted position 15300 and the second opening line 15410 and the first closing line 15030 are payed out by operation of the second opening winch 15400 and the first closing winch 15080, as shown in FIG. 15*c*. The second opening line 15410 and the first closing line 15030 are joined together by a tether 15440.

A second weight 15450 is attached to the first opening line 15010 and the second closing line 15430 for moving the first opening line 15010 and a submerged portion of the second closing line 15430 to the bottom of the body of water when the barrier gate 15020 is in the second retracted position and the first opening line 15010 and the second closing line 15430 are payed out by operation of the first opening winch 15070 and the second closing winch 15420. The first opening line 15010 and the second closing line 15430 are joined to each other by a tether (not shown).

It is, therefore, apparent that there is provided in accordance with the present disclosure, cable management devices and methods for a marine barrier system. While it has been described in conjunction with a number of embodiments, it is evident that many alternatives, modifications and variations would be or are apparent to those of ordinary skill in the applicable arts. This application intends to embrace all such alternatives, modifications, equivalents and variations that are within the spirit and scope of this disclosure.

What is claimed is:

1. A marine gate comprising:

a buoyant, variable length barrier gate;

wherein when the barrier gate is floating in a body of water, the barrier gate is movable from a fully expanded position where the barrier gate extends from a substantially stationary first attachment point to a substantially stationary second attachment point remote from the first attachment point, to a retracted position where the barrier gate extends from the first attachment point to a location between the first and second attachment points; and wherein the first attachment point is attached to a first end of the barrier gate;

the marine gate further comprising:

an opening winch disposed at the first attachment point, the opening winch having an opening line attached proximal to a second end of the barrier gate opposite the first end of the barrier gate, for moving the barrier gate from the fully expanded position to the retracted position by operation of the opening winch;

a closing winch disposed at the second attachment point, the closing winch having a closing line attached proximal to the second end of the barrier gate, for moving the barrier gate from the retracted position to the fully expanded position by operation of the closing winch; and a weight attached to the closing line for moving a submerged portion of the closing line to the bottom of the body of water when the barrier gate is in the retracted position and the closing line is payed out by operation of the closing winch;

wherein the weight is movably mounted to the closing line such that motion of the weight relative to the closing line is limited, and a position of the weight along the closing line is adjustable according to environmental conditions or a depth of the body of water.

2. The marine gate of claim 1, wherein at least one of the opening and closing lines comprises a cable or a polymer.

3. The marine gate of claim 1, wherein the opening line is movably supported by the barrier gate between the first attachment point and the second end of the barrier gate.

4. The marine gate of claim 1, comprising a rolling sheave assembly for engaging the closing line and the weight to slidably mount the weight to the closing line and suspend the weight from the closing line; the sheave assembly including a tether for attaching the sheave assembly to the barrier gate or to a second sheave assembly, to limit the motion of the sheave assembly relative to the closing line.

5. A marine gate comprising:

a buoyant, variable length barrier gate;

wherein when the barrier gate is floating in a body of water, the barrier gate is movable from a fully expanded position where the barrier gate extends from a substantially stationary first attachment point to a substantially stationary second attachment point remote from the first attachment point, to a retracted position where the barrier gate extends from the first attachment point to a location between the first and second attachment points; and wherein the first attachment point is attached to a first end of the barrier gate;

the marine gate further comprising:

an opening winch disposed at the first attachment point, the opening winch having an opening line attached proximal to a second end of the barrier gate opposite the first end of the barrier gate, for moving the barrier gate from the fully expanded position to the retracted position by operation of the opening winch;

a closing winch disposed at the second attachment point, the closing winch having a closing line attached proximal to the second end of the barrier gate, for moving the barrier gate from the retracted position to the fully expanded position by operation of the closing winch; and a weight attached to the closing line for moving a submerged portion of the closing line to the bottom of the body of water when the barrier gate is in the retracted position and the closing line is payed out by operation of the closing winch;

wherein the closing line comprises RFID sensors;

wherein the marine gate further comprises RFID antennas located at or near the bottom of the body of water for determining when the closing line is in a predetermined position.

6. A marine gate comprising:

a buoyant, variable length barrier gate;

wherein when the barrier gate is floating in a body of water, the barrier gate is movable from a fully expanded position where the barrier gate extends from a substantially stationary first attachment point to a substantially stationary second attachment point remote from the first attachment point, to a retracted position where the barrier gate extends from the first attachment point to a location between the first and second attachment points; and wherein the first attachment point is attached to a first end of the barrier gate;

the marine gate further comprising:

an opening winch disposed at the first attachment point, the opening winch having an opening line attached proximal to a second end of the barrier gate opposite the first end of the barrier gate, for moving the barrier gate from the fully expanded position to the retracted position by operation of the opening winch;

a closing winch disposed at the second attachment point, the closing winch having a closing line attached proximal to the second end of the barrier gate, for moving the barrier gate from the retracted position to the fully expanded position by operation of the closing winch; and a weight attached to the closing line for moving a submerged portion of the closing line to the bottom of the body of water when the barrier gate is in the retracted position and the closing line is payed out by operation of the closing winch;

wherein when the barrier gate is floating in a body of water, the barrier gate is further movable from the fully expanded position to a second retracted position where the barrier gate extends from the second attachment point to a location between the first and second attachment points; and wherein the first attachment point is removably attached to the first end of the barrier gate;

the marine gate further comprising:

a second opening winch disposed at the second attachment point, the second opening winch having a second opening line attached proximal to the first end of the barrier gate for moving the barrier gate from the fully expanded position to the second retracted position by operation of the second opening winch, wherein when the second opening winch operates to pay in the second opening line to move the barrier gate from the fully expanded position to the second retracted position, the opening winch pays out the opening line;

a second closing winch disposed at the first attachment point, the second closing winch having a second closing line attached proximal to the second end of the barrier gate, for moving the barrier gate from the second retracted position to the fully expanded position by operation of the second closing winch;

a second weight attached to the opening line and the second closing line for moving the opening line and a submerged portion of the second closing line to the bottom of the body of water when the barrier gate is in the second retracted position and the opening line and the second closing line are payed out by operation of the opening winch and the second closing winch.

7. The marine gate of claim 6, wherein when the opening winch operates to pay in the opening line to move the barrier gate from the fully expanded position to the retracted position, the second opening winch pays out the second opening line; and wherein the weight is attached to the second opening line and the closing line for moving the second opening line and a submerged portion of the closing line to the bottom of the body of water when the barrier gate is in the retracted position and the second opening line and the closing line are payed out by operation of the second opening winch and the closing winch.

* * * * *